US007116932B2

(12) United States Patent
Takeuchi et al.

(10) Patent No.: US 7,116,932 B2
(45) Date of Patent: Oct. 3, 2006

(54) DEVELOPING UNIT AND IMAGE FORMING APPARATUS

(75) Inventors: Nobutaka Takeuchi, Kanagawa (JP); Hajime Oyama, Chiba (JP); Hiromitsu Takagaki, Kanagawa (JP); Takayuki Koike, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 165 days.

(21) Appl. No.: 10/872,438

(22) Filed: Jun. 22, 2004

(65) Prior Publication Data

US 2004/0265014 A1 Dec. 30, 2004

(30) Foreign Application Priority Data

Jun. 27, 2003 (JP) ..... 2003-184894

(51) Int. Cl.
*G03G 15/09* (2006.01)

(52) U.S. Cl. ..... 399/274; 399/375; 399/384

(58) Field of Classification Search ..... 399/274, 399/275

See application file for complete search history.

(56) References Cited

U.S. PATENT DOCUMENTS

| | | | | |
|---|---|---|---|---|
| 4,165,393 | A | 8/1979 | Suzuki et al. | |
| 4,171,899 | A | 10/1979 | Yanagawa et al. | |
| 4,193,679 | A | 3/1980 | Mochnizuki et al. | |
| 4,194,830 | A | 3/1980 | Ohnuma et al. | |
| 4,201,465 | A | 5/1980 | Oyama et al. | |
| 4,286,543 | A | 9/1981 | Ohnuma et al. | |
| 4,350,749 | A | 9/1982 | Ohnuma et al. | |
| 4,382,420 | A | 5/1983 | Ohnuma et al. | |
| 4,406,536 | A | 9/1983 | Suzuki et al. | |
| 4,760,427 | A | 7/1988 | Oyama et al. | |
| 4,792,825 | A | 12/1988 | Saito et al. | |
| 4,821,075 | A | 4/1989 | Saito et al. | |
| 4,989,043 | A | 1/1991 | Suzuki et al. | |
| 5,083,160 | A | 1/1992 | Suzuki et al. | |
| 5,182,600 | A | 1/1993 | Hasegawa et al. | |
| 5,198,861 | A | 3/1993 | Hasegawa et al. | |
| 5,260,748 | A * | 11/1993 | Kahle | 399/274 |
| 5,450,177 | A | 9/1995 | Oyama | |

(Continued)

FOREIGN PATENT DOCUMENTS

| | | |
|---|---|---|
| JP | 5-35067 | 2/1993 |

(Continued)

OTHER PUBLICATIONS

U.S. Appl. No. 11/210,826, filed Aug. 25, 2005, Matsuura et al.

*Primary Examiner*—David M. Gray
*Assistant Examiner*—Ruth N. LaBombard
(74) *Attorney, Agent, or Firm*—Oblon, Spivak, McClelland, Maier & Neustadt, P.C.

(57) ABSTRACT

A developing unit includes a developer containing unit that contains developer, a developer carrier that has a moving surface, and carries the developer, a magnetic force generator that attracts the developer onto the moving surface by a magnetic force generated from a plurality of magnets, and a restricting member that restricts a layer thickness of the developer. The magnets includes a restricting magnet arranged closest to the restricting member and has a restricting magnetic pole of which a first surface toward the moving surface and a second surface toward an upstream adjacent magnet that is arranged so as to be adjacent to an upstream side of the developer carrier in a direction of movement of the moving surface and has an upstream adjacent magnetic pole form a ridged corner portion, and the ridged corner portion is chamfered.

44 Claims, 7 Drawing Sheets

U.S. PATENT DOCUMENTS 5,467,175 A 11/1995 Takagaki et al.
5,493,382 A 2/1996 Takagaki et al.
5,502,552 A 3/1996 Iwata et al.
5,604,575 A 2/1997 Takagaki et al.
5,655,200 A 8/1997 Oyama
5,659,860 A 8/1997 Sasaki et al.
5,737,680 A 4/1998 Takagaki et al.
5,758,241 A 5/1998 Oyama et al.
5,771,426 A 6/1998 Oka et al.
5,771,429 A 6/1998 Oyama et al.
5,805,965 A 9/1998 Tsuda et al.
5,822,664 A 10/1998 Oka et al.
5,864,733 A 1/1999 Mae et al.
5,937,228 A 8/1999 Shoji et al.
5,953,568 A 9/1999 Fujishiro et al.
6,035,169 A * 3/2000 Miyake et al. ..... 399/282
6,081,684 A * 6/2000 Naganuma et al. ..... 399/275
6,366,751 B1 4/2002 Shakuto et al.
6,442,364 B1 8/2002 Kai et al.
6,463,244 B1 10/2002 Aoki et al.
6,505,014 B1 1/2003 Aoki et al.
6,526,248 B1 2/2003 Aoki et al.
6,597,885 B1 7/2003 Kai et al.
6,611,672 B1 8/2003 Aoki et al.
6,625,409 B1 9/2003 Shakuto et al.
6,654,579 B1 11/2003 Shakuto et al.
6,658,227 B1 12/2003 Oyama et al.
6,665,511 B1 12/2003 Takeuchi et al.
6,721,516 B1 * 4/2004 Aoki et al. ..... 399/55
6,757,509 B1 6/2004 Shoji et al.
6,778,805 B1 8/2004 Kai et al.
6,844,126 B1 * 1/2005 Ohmura et al. ..... 430/110.3
6,898,406 B1 * 5/2005 Suzuki et al. ..... 399/277
6,963,720 B1 * 11/2005 Endo et al. ..... 430/110.3
2002/0028093 A1 * 3/2002 Miyoshi et al. ..... 399/277
2004/0265014 A1 12/2004 Takeuchi et al.

FOREIGN PATENT DOCUMENTS

JP 9-146374 6/1997
JP 11-161007 6/1999

* cited by examiner

DEVELOPING UNIT AND IMAGE FORMING APPARATUS

CROSS-REFERENCE TO RELATED APPLICATIONS

The present document incorporates by reference the entire contents of Japanese priority document, 2003-184894 filed in Japan on Jun. 27, 2003.

BACKGROUND OF THE INVENTION

1) Field of the Invention

The present invention relates to a developing unit that develops a latent image on a latent image carrier with developer carried on a surface of a developer carrier by magnetic force, and an image forming apparatus employing the developing unit such as a copying machine, a facsimile, and a printer.

2) Description of the Related Art

Conventionally, a developing unit of a two-component developing system where a latent image carried on a latent image carrier such as a photosensitive member is developed using two-component developer containing non-magnetic toner and magnetic carrier that includes magnetic particles has been known. Such a developing unit has a developer carrier constituted of a non-magnetic pipe or the like, which includes therein a magnetic force generator such as a magnet roller, and a developer containing unit that contains two-component developer. The developer carrier is driven by a driving unit such that a surface thereof is moved in a predetermined direction. The developer carrier attracts and draws two-component developer on its surface due to magnetic force generated by magnetic poles of the magnetic force generator on a region thereof facing the developer containing unit. The drawn two-component developer constitutes a magnetic brush by spiking magnetic carrier along lines of magnetic force and is conveyed to a developing region which is a region facing the latent image carrier according to surface movement of the developer carrier. In the developing region, toner is transferred from the magnetic carrier surface to a latent image on the latent image carrier so that the latent image is developed to a toner image. Prior to the development, the magnetic brush is restricted in layer thickness thereon by such a restricting member as a doctor blade arranged to face the surface of the developer carrier via a predetermined gap, so that stabilization of a conveyance amount of toner to the developing region and enforcement of frictional charging are performed.

Toner used in the two-component developer or the like is added on its surface with additives such as silica, titanium oxide in order to improve its ability to disperse. These additives are weak in mechanical stress and they are burred in the toner or released from the surface thereof according to stirring the toner inside the developing unit, which causes degradation of the toner easily. The toner degraded due to the burring or releasing of the additives is poor in frictional charging performance so that a charge amount does not rise easily even if stirring is started in the developing unit. Toner adheres to a non-image portion of the latent image carrier to cause so-called background dirt, or the toner stays and accumulates on a surface of the developer carrier for a long term without contributing to development, which results in remarkable lowering of an image density.

On the other hand, it is known that the magnetic carrier in the two-component developer is also subjected to mechanical stress so that a surface layer thereof is gradually cut, which result in deterioration of frictional charging performance of the magnetic carrier. The magnetic carrier whose frictional charging performance has been deteriorated cannot charge toner excellently.

The two-component developer or one-component developer that does not include magnetic carrier deteriorates in a time elapsing manner by applying mechanical stress on toner or magnetic carrier (the one-component developer and the two-component developer are hereinafter called "developer", collectively). In recent years, as further fineness or higher image quality have been demanded, it is a significant problem to suppress time-elapsing deterioration of the developer.

With a view to the above problem, Japanese Patent Application Laid-open No. H11-161007 proposes a developing unit of a two-component development system where a distal end edge portion of a magnetic plate serving as a restricting member has been chamfered. The Japanese Patent Application Laid-open No. H11-161007 describes that stress acting on two-component developer at a time of a restricting process can be reduced by performing such chamfering.

Japanese Patent Application Laid-open No. H9-146374 proposes a developing unit of a two-component development system which is provided with a magnet roller for developer retaining. The magnet roller for developer retaining faces a developing sleeve via a predetermined gap in an upstream side of a doctor blade serving as a restricting member in a rotating direction of the developing sleeve, and a surface movement thereof is rotationally driven in the same direction as a surface of the developing sleeve in the facing region. The Japanese Patent Application Laid-open No. H9-146374 describes that the magnet roller for developer retaining with such a constitution can securely reduce the amount of the two-component developer colliding against the doctor blade to decrease stress acting on the developer.

As described later, the present inventors have found that a principal cause of degradation of two-component developer lies in friction occurring between "an immovable layer" and "a following rotation layer" of the two-component developer on a surface of a developer carrier. The term "immovable layer" means a layer that hardly moves to stay at a position thereof abutting against a restricting member on the surface of the developer carrier. The term "following rotation layer" means a layer which is one (the surface side of the developer carrier) lower than the "immovable layer" and rotates actively in a following manner according to surface movement of the developer carrier. Even in a developing unit using magnetic one-component developer (magnetic toner) that does not contain magnetic carrier or non-magnetic one-component developer (non-magnetic toner), a material similar to the "immovable layer" is easily formed on an upstream side of the restricting member. As a conventional art where staying of non-magnetic one-component developer on the upstream side of the restricting position is noticed in view of stabilization of an conveyance amount of developer to the developing region, a developing unit described in Japanese Patent Application Laid-open No. H5-35067 has been known. The developing unit is provided with a cylindrical developer conveying member that rotates while facing a developer carrier via a predetermined gap on an upstream side of a restricting member in a direction of surface movement, or a surface movement direction, of the developer carrier. In the Japanese Patent Application Laid-open No. H5-35067, a layer comprising non-magnetic one-component developer staying on the upstream side of the restricting position is referred to as "an immovable layer". The Japanese Patent Application Laid-open No. H5-35067 describes that the immovable layer is prevented from being formed by providing the developer conveying member.

As mentioned above, the Japanese Patent Application Laid-open No. H11-161007 and Japanese Patent Application Laid-open No. H9-146374 describe that stress acting on two-component developer can be reduced by the chamfer or the magnet roller for developer retaining. As a result of studies by the present inventors, however, it is found that there is a problem that degradation progress cannot be suppressed sufficiently or degradation progress may be accelerated on the contrary even in these developing units.

FIG. 1 is an enlarged view of a partial constitution of a conventional developing unit of a two-component developing system. In a developing unit 20 shown in FIG. 1, a developing sleeve 22 constituted of a non-magnetic pipe serving as a developer carrier is rotationally driven by a driving unit (not shown) in a clockwise direction in FIG. 1. A magnet roller 23 having plural magnetic poles arranged in a circumferential direction thereof, which serves as a magnetic force generator, is fixedly arranged inside the developing sleeve 22 so as not to rotate according to rotation of the developing sleeve 22. A doctor blade 24 serving as a restricting member is disposed above the developing sleeve 22 in FIG. 1 such that a distal end face thereof faces a surface of the developing sleeve 22 via a predetermined gap.

A developer containing unit that contains two-component developer is provided in a region (not shown) inside the developing unit 20. The developing sleeve 22 rotates while is pumping two-component developer on a surface of the developing sleeve due to magnetic force generated by a pumping magnetic pole disposed in a region (not shown) of the magnet roller 23, so that two-component developer inside the developer containing unit is drawn up. The two-component developer drawn up clusters magnetic carrier along lines of magnetic force extending from the magnet roller 23 to form a magnetic brush. The magnetic brush is conveyed toward the doctor blade 24 according to rotation of the developing sleeve 22. At a position where developer is restricted by the doctor blade 24, a root side portion (a portion positioned on a surface side of the sleeve) of the magnetic brush formed to be thick on the surface of the developing sleeve 22 easily passes through the gap but a distal end portion thereof abuts on the doctor blade 24. If the distal end portion merely abuts on the doctor blade, the portion is replaced with the following root side portion of the magnetic brush little by little while being circulated in a convection manner on the upstream side of the doctor blade 24 in the sleeve rotating direction, so that it can gradually pass through the gap. However, lines of magnetic force from the magnet roller 23 reaches not only a root side region of the magnetic brush relatively near to the surface of the developing sleeve 22 but also a distal end side region thereof relatively far from the surface of the developing sleeve 22. Accordingly, the distal end side portion of the magnetic brush which has abutted on the doctor blade 24 is continuously constrained thereat due to magnetic force to stay without causing convection and form an immovable layer Ly1. A following rotation layer Ly2 due to the root side portion of the magnetic brush which easily passes through the gap while rotating according to the developing sleeve 22 is formed below the immovable layer Ly1.

The present inventors have photographed and observed behavior of a magnetic brush around the doctor blade 24 by a high speed camera with a high magnification as regard an experimental machine of the developing unit 20 with such a constitution and have found the following phenomenon. That is, in a boundary of the immovable layer Ly1 staying on an upstream side of the doctor blade 4 without almost movement and the following rotation layer Ly2 actively moving according to the developing sleeve 22, both the layers are violently rubbed to each other. The present inventors have supposed that regarding mechanical stress on the two-component developer on the developing sleeve 22, mechanical stress acting when the developer passes through the gap between the doctor blade 24 and the developing sleeve 22 is larger than that acting due to friction between both the layers.

Therefore, the present inventors have researched the influence to degradation of the two-component developer due to friction between both the layers. Specifically, a cause of formation of the immovable layer Ly1 lies in that a distal end portion of a magnetic brush whose following rotation is blocked by the doctor blade 24 continues to be constrained thereat due to magnetic force from magnet roller 22. When magnetic force or a shape of a restricting magnetic pole Px positioned so as to face the doctor blade 24 within the magnet roller 22 or an upstream adjacent magnetic pole Py positioned at an upstream side of the restricting magnetic pole is adjusted, magnitude or shape of a magnetic field affecting on the distal end portion of the magnetic brush can be change. The present inventors have made a research on the degree of degradation progress of the two-component developer while changing the size or shape of the immovable layer Ly1 variously in this manner. It is that as the length Lx of the immovable layer in the rotational direction of the sleeve (in the direction of the following rotation) becomes longer, degradation of the two-component developer is accelerated. It has also been found that, even if the amount of the two-component developer forming the immovable layer Ly1 is relatively much, when the length Lx of the immovable layer is relatively short, i.e., the immovable layer Ly1 is formed such that its size is long in a lengthwise direction thereof, degradation of the two-component developer does not progress so much. On the other hand, it has been found that, even if the amount of the two-component developer forming the immovable layer Ly1 is relatively less, when the length Lx of the immovable layer is relatively long, i.e., the immovable layer Ly1 is formed such that its size is long in a widthwise direction, degradation of the two-component developer progresses rapidly. It is considered such a fact is because the magnetic force of the magnet roller 23 rather than the weight of the immovable layer Ly2 acts as a factor which increases frictional force per unit area between both the layers, and as the length Lx of the immovable layer becomes longer, a friction time between the both layers becomes long.

The developing unit described in the Japanese Patent Application Laid-open No. H11-161007 corresponds to a structure where the distal end of the blade has been chamfered at a position indicated with a one-dot chain line in FIG. 1 in the constitution shown in FIG. 1. The chamfering allows the magnetic brush to pass through the gap between the doctor blade 24 and the developing sleeve 22 smoothly. However, since almost all of the mechanical stress to the magnetic brush occurs due to friction between the immovable layer Ly1 and the following rotating layer Ly2, it is considered that, even if slight stress occurring when the magnetic brush passes through the gap is only reduced, degradation progress of the two-component developer cannot be suppressed sufficiently.

The developing unit described in the Japanese Patent Application Laid-open No. H9-146374 corresponds to a structure where a magnet roller for developer retaining has been arranged at a position indicated with a dotted circle in FIG. 1 in the constitution shown in FIG. 1. The magnet roller for developer retaining is rotationally driven in a counter-clockwise direction such that a surface thereof facing the developing sleeve 22 is moved in the same direction as the sleeve. The magnetic brush on the surface of the developing sleeve 22 passes through the gap between the magnet roller for developer retaining and the developing sleeve 22 before it reaches a position where restriction is conducted by the doctor blade 24. In the region between the magnet roller for developer retaining and the doctor blade 24, excessive two-component developer is conveyed according to rotation of the magnet roller for developer retaining in a direction of arrow C in FIG. 1 to be returned back to the developer containing unit (not shown). Since the excessive two-component developer is returned in this manner, a possibility is made high that an immovable layer is hardly formed. However, the magnetic brush is eventually forced into the gap formed in a tapered manner by surface movements of both the magnet roller for developer retaining and the developer sleeve 22 approaching to each other in the region therebetween. It is thought that, when the magnetic brush is forced into the gap, remarkably large stress is imparted on the two-component developer. The excessive two-component developer which has passed through the tapered gap is caused to contact with a side face of the doctor blade 24 in a rubbing manner by the following rotation according to rotation of the magnet roller for developer retaining in a returning course in the direction of arrow C. As a result, there arises a problem that degradation progress of the two-component developer cannot be suppressed sufficiently, or it may be accelerated on the contrary.

On the other hand, the developing unit described in the Japanese Patent Application Laid-open No. H5-35067 employs a non-magnetic one-component development system. When the developer conveying member of the developing unit is adopted in the constitution of the two-component developing system shown in FIG. 1, a cylindrical member is eventually arranged at a position indicated with a dotted circle in FIG. 1 via a predetermined gap with the developing sleeve 22. The cylindrical member is rotationally driven in a clockwise direction in FIG. 1 such that its surface facing the developing sleeve 22 is moved in a direction reversed to the rotational direction of the sleeve. Such a cylindrical member is provided so that, when the developer is non-magnetic one-component developer, staying of the developer in the vicinity of the doctor blade 24 can be solved. However, the two-component developer or the magnetic one-component developer has a high possibility that it forms an immovable layer between the cylindrical member and the doctor blade 24, because excessive developer occurring slightly between the both is continued to be restrained thereat due to magnetic force of the magnet roller 22. There is a possibility that excessive developer that has not passed through the gap between the cylindrical member and the developing sleeve 22 is deposited to form an immovable layer even on the upstream side of the cylindrical member in the rotational direction of the sleeve. Even if the excessive developer is not formed in the immovable layer owing to circulating convection according to rotation of the cylindrical member, it is rubbed against the cylindrical member or the following rotation layer violently. As a result, there is found a problem that degradation progress of the developer cannot be suppressed sufficiently or it is accelerated on the contrary.

SUMMARY OF THE INVENTION

It is an object of the present invention to solve at least the above problems in the conventional technology.

The developing unit that develops a latent image carried on a latent image carrier of an image forming apparatus, according to one aspect of the present invention, includes a developer containing unit that contains developer, a developer carrier that has a moving surface, and carries the developer on the moving surface, a magnetic force generator that attracts the developer onto the moving surface by a magnetic force generated from a plurality of magnets arranged along the moving surface, and a restricting member that restricts a layer thickness of the developer carried on the moving surface. The magnets include a restricting magnet that is arranged closest to the restricting member and has a restricting magnetic pole. A first surface of the restricting magnet toward the moving surface and a second surface of the restricting magnet toward an upstream adjacent magnet that is arranged so as to be adjacent to an upstream side of the developer carrier in a direction of movement of the moving surface and has an upstream adjacent magnetic pole form a ridged corner portion, and the ridged corner portion is chamfered.

The developing unit that develops a latent image carried on a latent image carrier of an image forming apparatus, according to another aspect of the present invention, includes a developer containing unit that contains developer, a developer carrier that has a moving surface, and carries the developer on the moving surface, a magnetic force generator that attracts the developer onto the moving surface by a magnetic force generated from a plurality of magnets arranged along the moving surface, and a restricting member that restricts a layer thickness of the developer carried on the moving surface. The magnetic force generator is constituted in such a manner that a peak point of magnetic flux density on the moving surface in a direction parallel to the moving surface between a restricting magnetic pole that is arranged closest to the restricting member and an upstream adjacent magnetic pole that is arranged so as to be adjacent to the restricting magnetic pole on an upstream side of the developer carrier in a direction of movement of the moving surface is positioned on a downstream side in the direction of movement of the moving surface than a point where the magnetic force density in a normal direction to the moving surface formed by opposite magnetic poles becomes zero.

The image forming apparatus according to still another aspect of the present invention includes a latent image carrier that carries a latent image, and a developing unit that develops the latent image carried on the latent image carrier. The developing unit includes a developer containing unit that contains developer, a developer carrier that has a moving surface, and carries the developer on the moving surface, a magnetic force generator that attracts the developer onto the moving surface by a magnetic force generated from a plurality of magnets arranged along the moving surface, and a restricting member that restricts a layer thickness of the developer carried on the moving surface. The magnets includes a restricting magnet that is arranged closest to the restricting member and has a restricting magnetic pole. A first surface of the restricting magnet toward the moving surface and a second surface of the restricting magnet toward an upstream adjacent magnet that is arranged so as to be adjacent to an upstream side of the developer carrier in a direction of movement of the moving surface and has an upstream adjacent magnetic pole form a ridged corner portion, and the ridged corner portion is chamfered.

The image forming apparatus according to still another aspect of the present invention includes a latent image carrier that carries a latent image, and a developing unit that develops the latent image carried on the latent image carrier. The developing unit includes a developer containing unit that contains developer, a developer carrier that has a moving surface, and carries the developer on the moving surface, a magnetic force generator that attracts the developer onto the moving surface by a magnetic force generated from a plurality of magnets arranged along the moving surface, and a restricting member that restricts a layer thickness of the developer carried on the moving surface. The magnetic force generator is constituted in such a manner that a peak point of magnetic flux density on the moving surface in a direction parallel to the moving surface between a restricting magnetic pole that is arranged closest to the restricting member and an upstream adjacent magnetic pole that is arranged so as to be adjacent to the restricting magnetic pole on an upstream side of the developer carrier in a direction of movement of the moving surface is positioned on a downstream side in the direction of movement of the moving surface than a point where the magnetic force density in a normal direction to the moving surface formed by opposite magnetic poles becomes zero.

The other objects, features, and advantages of the present invention are specifically set forth in or will become apparent from the following detailed description of the invention when read in conjunction with the accompanying drawings.

DETAILED DESCRIPTION

Exemplary embodiments of a developing unit and an image forming apparatus according to the present invention are explained in detail with reference to the accompanying drawings. A color laser printer of a tandem type (hereinafter, "printer") is explained as an embodiment of an image forming apparatus to which the present invention is applied.

Figure 2:
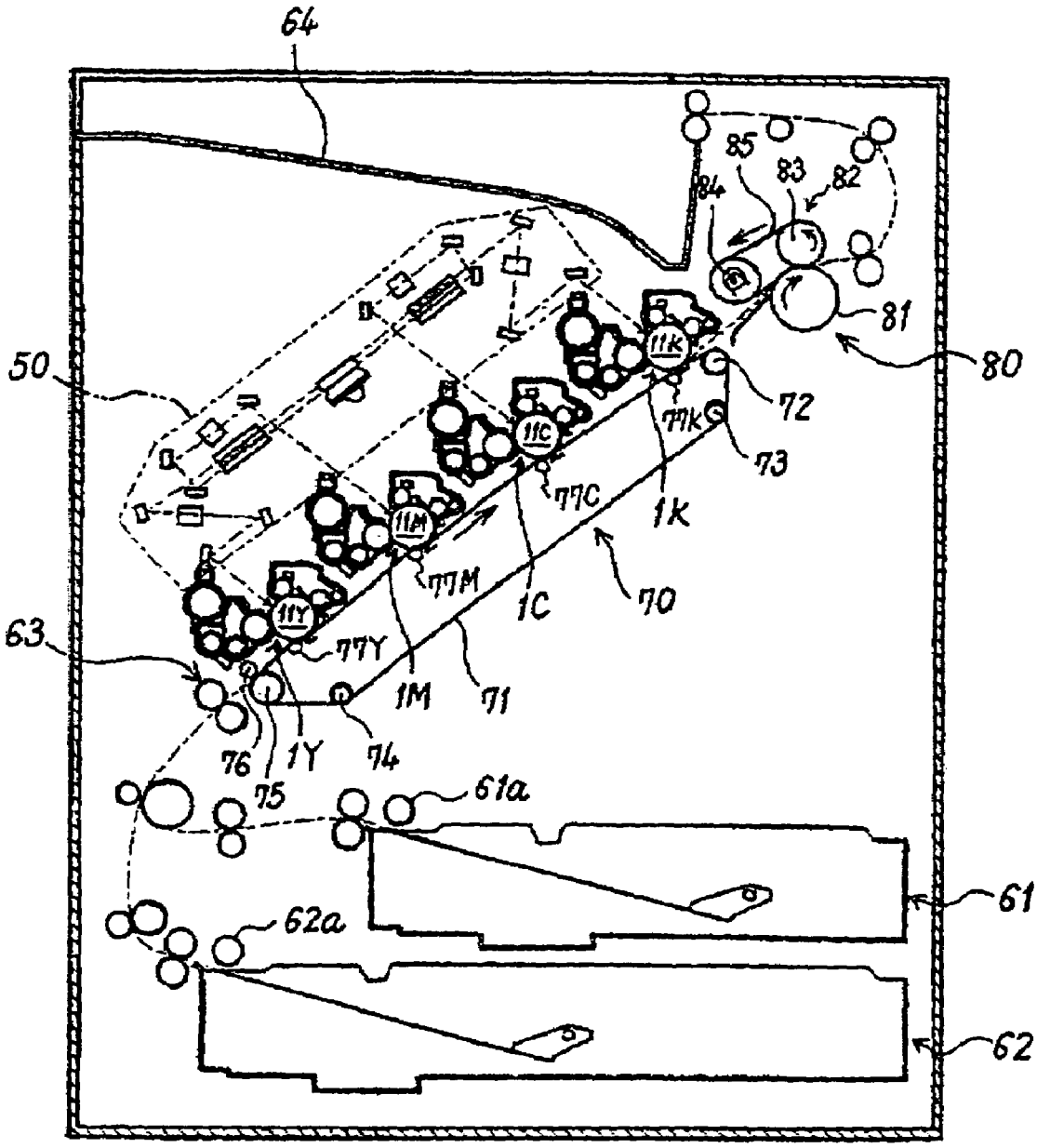
FIG. 2 is a schematic configuration view of a printer according to an embodiment.

FIG. 2 is a schematic constitution view of a printer according to this embodiment. The printer is provided with four sets of toner image forming units 1Y, 1M, 1C, and 1K which form respective color images of yellow (Y), magenta (M), cyan (C), and black (K). Hereinafter, subscripts of respective signs Y, M, C, and K indicate members for yellow, magenta, cyan, and black, respectively.

The toner image forming units 1Y, 1M, 1C, and 1K have drum-like photosensitive members 11Y, 11M, 11C, and 11K serving as latent image carriers. The printer is also provided with an optical write unit 50, paper feed cassettes 61 and 62, a registration roller pair 63, a transfer unit 70, a fusing unit of a belt fusing type 80, and a paper discharge tray 64 in addition to the toner image forming units 1Y, 1M, 1C, and 1K. The printer is further provided with a manually feed tray (not shown), a toner replenishing container, a waste toner bottle, a duplex/reverse unit, a power supply unit and the like.

The optical write unit 50 is provided with an optical source, a polygon mirror, an f-θ lens, a reflecting mirror and the like. The optical write unit 50 irradiates laser beams on surfaces of the respective photosensitive members 11Y, 11M, 11C, and 11K on the basis of image data while performing scanning.

Figure 3:
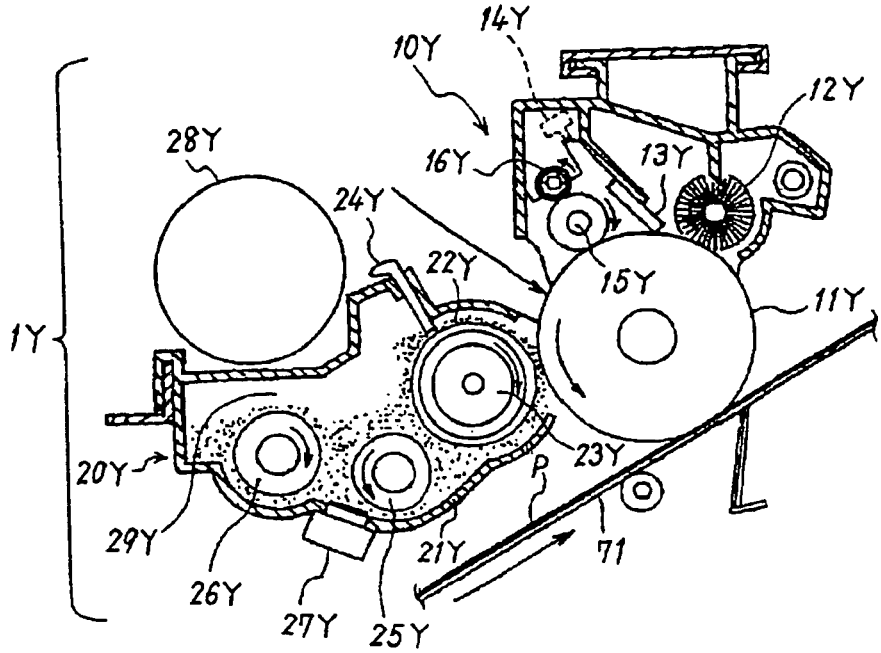
FIG. 3 is an enlarged view which depicts a schematic constitution of a toner image forming unit for yellow color in the printer together with a portion of a transfer unit.

FIG. 3 is an enlarged constitution view which depicts a schematic constitution of the yellow toner image forming unit 1Y of the toner image forming units 1Y, 1M, 1C, and 1K and a portion of the transfer unit 70. Since the other toner image forming units (1M, 1C, and 1K) have the same constitution as above, explanation thereof will be omitted. In FIG. 3, the toner image forming unit 1Y is provided with a process unit 10Y and a developing unit 20Y. In addition to the photosensitive member 11Y with a diameter of 90 millimeters which is rotationally driven in a counterclockwise direction in FIG. 3, the process unit 10Y is provided with a brush roller 12Y which applies lubricant to a surface of the photosensitive member 11Y, a swingable counter blade 13Y which performs a cleaning processing thereon and the like. The process unit 10Y has a charge removing lamp 14Y which performs a charge removing processing, a charging roller 15Y which charges the photosensitive member 11Y uniformly, a roller cleaning device 16Y which cleans the surface of the photosensitive member, and the like.

In the process unit 10Y, the charging roller 15Y to which AC charging bias is applied by a power supply (not shown) is disposed so as to abut on the photosensitive member 11Y. The charging roller 15Y charges the surface of the photosensitive member 11 uniformly while it is being rotated such that a surface thereof is moved in a direction reverse to surface movement of the photosensitive member 11Y in the abutting portion of the charging roller 15Y by a driving unit (not shown). Laser beam modulated and deflected by the optical write unit (reference sign 50 in FIG. 2) is irradiated on the surface of the photosensitive member 11Y changed uniformly in this manner, while being scanned, so that an electrostatic latent image is formed on the surface of the photosensitive member 11Y.

The developing unit 20Y is provided with a developing sleeve 22Y made of a non-magnetic pipe, which is disposed such that a portion thereof is exposed from an opening portion of a developing case 21Y, a magnet roller 23 serving as a magnetic force generator, which is included in the developing sleeve 22Y so as not to be rotated following the developing sleeve 22Y, and the like. The developing unit 20Y is provided with a doctor blade 24Y, a first conveying screw 25Y, a second conveying screw 26Y, a toner density sensor (hereinafter, called "a T sensor") 27Y, a powder pump 28Y, and the like. The diameter of the developing sleeve 22Y is 25 millimeters.

The developing case 21Y is formed with a developer containing unit 29Y which contains two-component developer including magnetic carrier comprising magnetic particles and non-magnetic Y toner with negative chargeability. The two-component developer is stirred and conveyed by the first conveying screw 25Y or the second conveying screw 26Y. The two-component developer is drawn up on a surface of the developing sleeve 22Y serving as a developer carrier in the vicinity of the developing sleeve 22Y due to magnetic pole generated by the magnet roller 23Y to form magnetic brush. The magnetic brush is restricted in layer thickness thereof by the doctor blade 24Y to be conveyed to a developing region facing the photosensitive member 11Y. In the developing region, a gap between a surface of the developing sleeve 22Y and a surface of the photosensitive member 11Y at a position where they approaches nearest to each other, namely, a developing gap is set to 0.3 millimeter. A distal end of the magnetic brush on the developing sleeve 22Y moves in the developing gap or in the vicinity thereof while being contacting with the surface of the photosensitive member 11Y in a rubbing manner, thereby causing Y toner to adhere to the electrostatic latent image. A Y toner image is formed on the photosensitive member 11Y by the adhesion. The magnetic brush whose Y toner has been consumed by the development is returned back to the developing case 21Y according to rotation of the developing sleeve 22Y. On the other hand, the developed Y toner image is conveyed and transferred on a transfer paper or sheet P while being retained on a surface of a transferring and conveying belt 71 described later.

The T sensor 27Y constituted of a magnetic permeability sensor is mounted on a bottom plate of the developing case 21Y to output a voltage with a value corresponding to magnetic permeability of two-component developer conveyed between the first conveying screw 25Y and the second conveying screw 26Y. Since the magnetic permeability of the two-component developer has an excellent correlation with the toner density in the two-component developer, the T sensor 27Y eventually outputs a voltage with a value corresponding to the Y toner density. The value of the output voltage is sent to a controller (not shown). The controller is provided with such a storing unit as a RMA, and the storing unit stores therein data including Vtref for Y which is a target value of an output voltage from the T sensor 27Y, Vtref for M, C, K from T sensors for the other colors. Regarding the developing device 20Y, the value of the output voltage from the T sensor 27Y and the Vtref for Y are compared with each other and the powder pump 28Y connected to a Y toner cartridge (not shown) is driven by a time period corresponding to the comparison result. Thereby, Y toner inside the Y toner cartridge is replenished to the developer containing unit 29Y. The drive of the powder pump 28Y is controlled (supply of toner is controlled) in this manner so that a proper amount of Y toner is replenished to the developer whose Y toner density has been lowered according to the development and the Y toner density in the developer inside the developing unit 20Y is maintained within a predetermined range. Regarding the other developing unit 20M, 20C, and 20K, a similar toner supply control is implemented.

Thus, the respective toner image forming units 1Y, 1M, 1C, and 1K form toner images on the respective photosensitive members 11Y, 11M, 11C, and 11K in cooperation with the optical write unit 50 shown in FIG. 2. Therefore, in this printer, the toner image forming device is constituted with combination of the respective toner image forming units 1Y, 1M, 1C, and 1K and the optical write unit 50.

Two paper feed cassettes 61 and 62 are arranged in a lower section of the printer main unit. The paper feed cassettes 61 and 62 accommodate transfer paper stacks (not shown) therein, where paper feed rollers 61*a* and 62*a* are pressed on the uppermost transfer papers. The transfer papers are fed out to a paper feeding path according to rotations of the paper feed rollers 61*a* and 62*a* at a predetermined timing. A registration roller pair 63 is arranged at an end of the paper feeding path, where the fed transfer paper is fed out toward the transfer unit 70 with a timing at which it is synchronized with the Y toner image formed on the photosensitive member 11Y of the Y toner image forming unit 1Y.

The transfer unit 70 has a transferring and conveying belt 71 which serves as a surface moving body and moves in a clockwise direction in FIG. 2 in an endless manner while coming in contact with the respective photosensitive members 11Y, 11M, 11C, and 11K to form transfer nips. The transferring and conveying belt 71 is entrained around four supporting rollers 72, 73, 74, and 75 such that it comes in contact with the photosensitive members 11Y, 11M, 11C, and 11K of the respective toner image forming units 1Y, 1M, 1C, and 1K to form four transfer nips. An electrostatic attracting roller 76 to which a predetermined voltage is applied from a power supply (not shown) is arranged so as to face the leftmost (in FIG. 2) supporting roller 75 of these supporting rollers. The transferring and conveying belt 71 can electrostatically attract a transfer paper P (not shown) on the front surface (a loop outer face) thereof due to charge application from the electrostatic attracting roller 76.

Transfer bias application rollers 77Y, 77M, 77C, and 77K coming in contact with a back surface of the transferring and conveying belt 71 are provided below the respective transfer nips. The transfer bias application rollers 77Y, 77M, 77C, and 77K are applied with transfer biases which are subjected to constant current control by a transfer bias power supply (not shown). Thereby, transfer charge is applied to the transferring and conveying belt 71, so that a transfer field with a predetermined intensity is formed between the transferring and conveying belt 71 and the surface of each photosensitive member in each transfer nip. In this printer, the transfer bias application rollers 77Y, 77M, 77C, and 77K are provided as transfer bias application members, but such members as brushes or blades may be provided instead of these rollers.

A one-dotted chain line in FIG. 2 indicates a conveying route for a transfer paper. A transfer paper fed from each of the paper feed cassettes 61 and 62 is conveyed by conveying rollers, while being guided by conveying guides (not shown), and it is sent to a temporary stopping position where a registration roller pair 63 is provided. A transfer paper sent out by the registration roller pair 63 at a predetermined timing is held by the transferring and conveying belt 71 and it sequentially passes through the transfer nips for Y, M, C, and K where it can come in contact with the photosensitive members 11Y, 11M, 11C, and 11K. Thereby, Y, M, C, and K toner images developed on the photosensitive members 11Y, 11M, 11C, and 11K of the respective toner image forming units 1Y, 1M, 1C, and 1K are superimposed on the transfer paper at the respective transfer nips to be transferred thereon owing to actions of the transfer fields and nip pressures. A full color image is formed on the transfer paper by the transferring action in the superimposing manner.

A transfer paper (not shown) on which a full color image has been formed is conveyed from a left and lower portion toward a right and upper portion in FIG. 2 according to endless movement of the transferring and conveying belt 71 to be delivered to the fusing unit 80. The fusing unit 80 is provided with a pressurizing roller 81 which is rotationally driven in a clockwise direction in FIG. 2 by a driving unit (not shown) and a fusing belt unit 82. The fusing belt unit 82 is provided with a drive roller 83 which is driven in a counterclockwise direction in FIG. 2 by a drive unit (not shown), a heating roller 84 which includes a heating source such as halogen lamp, and a fusing belt 85. The fusing belt 85 is moved in an endless manner in a counterclockwise direction in FIG. 2 in a state that it has been spanned between the drive roller 83 and the heating roller 84. The fusing belt 85 is heated to a temperature of 140 to 160° C. at a portion thereof spanned by the heating roller 84. The pressurizing roller 81 abuts on the front surface (the loop outer face) of the fusing belt 85 after heated to form a fusing nip. The transfer paper fed from the transferring and conveying belt 71 is nipped at the fusing nip to be pressurized while being heated. Thereby, a fusing processing is performed on the full color image on the transfer paper. After the transfer paper fused passes through a conveying roller pair and a paper discharging roller pair, it is stacked on a paper discharge tray 64 formed on an upper face of the printer housing.

In FIG. 3, the surface of the photosensitive member 11Y after a toner image has been transferred therefrom is applied with a predetermined amount of lubricant by a brush roller 12Y, and it is cleaned by a counter blade 13Y. The surface is charge-removed by light irradiated from a charge removing lamp 14Y and is prepared for the next formation of an electrostatic latent image.

Toner that has not been removed completely remains on the surface of the photosensitive member 11Y which has been cleaned by the counter blade 13Y. The toner remaining on the surface after cleaned adheres to the charging roller 15Y rotating while being in contact with the surface of the photosensitive member 11Y to cause dirt on the charging roller 15Y. If the dirt is left as it is, local charging failure is caused on the photosensitive member 11Y due to the remaining toner that has been deposited on the charging roller 15Y. The result is an abnormal image such as including a black stripe. Therefore, the process unit 10Y is provided with a roller cleaning device 16Y which cleans the residual toner after cleaned which has been adhered on the charging roller 15Y serving as a member to be cleaned.

Figure 4:
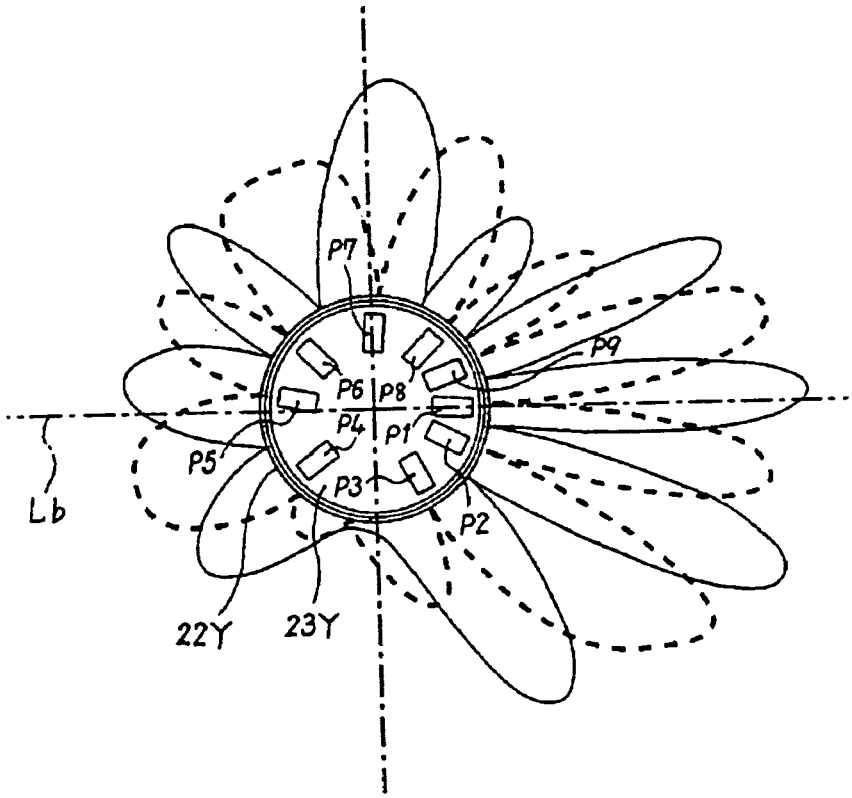
FIG. 4 depicts a magnetic field on a surface of a developing sleeve of a developing unit of the printer.

FIG. 4 depicts a magnetic field on a surface of the developing sleeve 22Y. In FIG. 4, the developing sleeve 22Y is rotationally driven in a clockwise direction in FIG. 4. The photosensitive member (11Y) is arranged such that its center point is positioned on the right side of the developing sleeve 22Y in FIG. 4 and on the center line Lb of the developing sleeve 22Y. The magnet roller 23Y fixed inside the developing sleeve 22Y in a non-rotatable manner is provided with nine magnetic poles arranged along the circumferential direction thereof. The magnetic pole of these magnetic poles denoted with a sign P1 is a developing pole for forming a magnetic brush on the surface of the developing sleeve 22Y. In FIG. 4, these rollers include a return conveying magnetic pole P2, a releasing magnetic pole P3, a pumping magnetic pole P4, a first conveying magnetic pole P5, a upstream adjacent magnetic pole P6, a doctor magnetic pole P7, a second conveying magnetic pole P8 and a third conveying magnetic pole P9 arranged in this order. These magnetic poles P1 to P9 are provided in an exclusive developing magnet, a return conveying magnet, a releasing magnet, a pumping magnet, a first conveying magnet, an upstream adjacent magnet, a doctor magnet, a second conveying magnet, a third conveying magnet, respectively. Though not shown, the doctor blade (24Y) is arranged above the doctor magnetic pole P7 so as to face the developing sleeve 22Y via a predetermined gas (hereinafter, "doctor gap").

Magnetic field is formed on a surface (hereinafter, "sleeve surface") of the developing sleeve 22Y due to magnetic forces generated from the plurality of magnetic poles. In FIG. 4, a solid line denotes a magnetic flux density extending in a normal direction in the magnetic field. In FIG. 4, a dotted line indicates a magnetic flux density extending in a tangential direction. A magnetic brush is formed on the surface of the developing sleeve 22Y in a shape extending along the magnetic flux in the tangential direction rather than that in the normal direction.

Two-component developer accommodated in the developer containing unit (29Y in FIG. 3) (not shown) is drawn due to magnetic field generated by the pumping magnetic pole P4 and drawn up on the surface of the sleeve rotating in a clockwise direction in FIG. 4, thereby forming a magnetic brush. The magnetic brush continues to be restrained on the surface of the sleeve due to magnetic fields from the first conveying magnetic pole P4 and the upstream adjacent magnetic pole P6. The magnetic brush is restricted in thickness thereof while it is being attracted on the surface of the sleeve due to magnetic field generated from the doctor magnetic pole P7. After the restricted magnetic brush is rotated in a follow-up manner while being attracted on the surface of the sleeve due to magnetic field generated from the second conveying magnetic pole P8 and the third conveying magnetic pole P9, it advances in magnetic field generated from the developing magnetic pole P1. After the electrostatic latent image on the photosensitive member (11Y) (not shown) has been developed, the magnetic brush sequentially advances in magnetic fields generated from the return conveying magnetic pole P3 and the pumping magnetic pole P4. A repelling magnetic field is formed between the return conveying magnetic pole P3 and the pumping magnetic pole P4. The magnetic brush is released from the surface of the sleeve due to the repelling magnetic field to be returned back to the developer containing unit (29Y) (not shown).

In FIG. 3 previously described, magnetic carrier is first thrown in the developer containing unit (29Y) in order to make the developing unit (20Y) from its initial state after factory shipment to its usable state. The Y toner bottle is set in the printer main unit and an operation for an initial setting of developer is performed. Thereby, Y toner in the Y toner bottle is replenished into the developing unit 20Y until two-component developer in the developer containing unit 29Y reaches a predetermined density. At that time, when an immovable layer described above is formed on an upstream side of the doctor blade 24 in the rotational direction of the sleeve, the toner density in the immovable layer becomes considerably lower than that of the two-component developer inside developer containing unit 29Y. Specifically, the toner density only becomes 0 to 0.05 wt % or less. On the other hand, the toner density in the following rotation layer becomes approximately the same as the two-component developer inside the developer containing unit 29Y.

Figure 5:
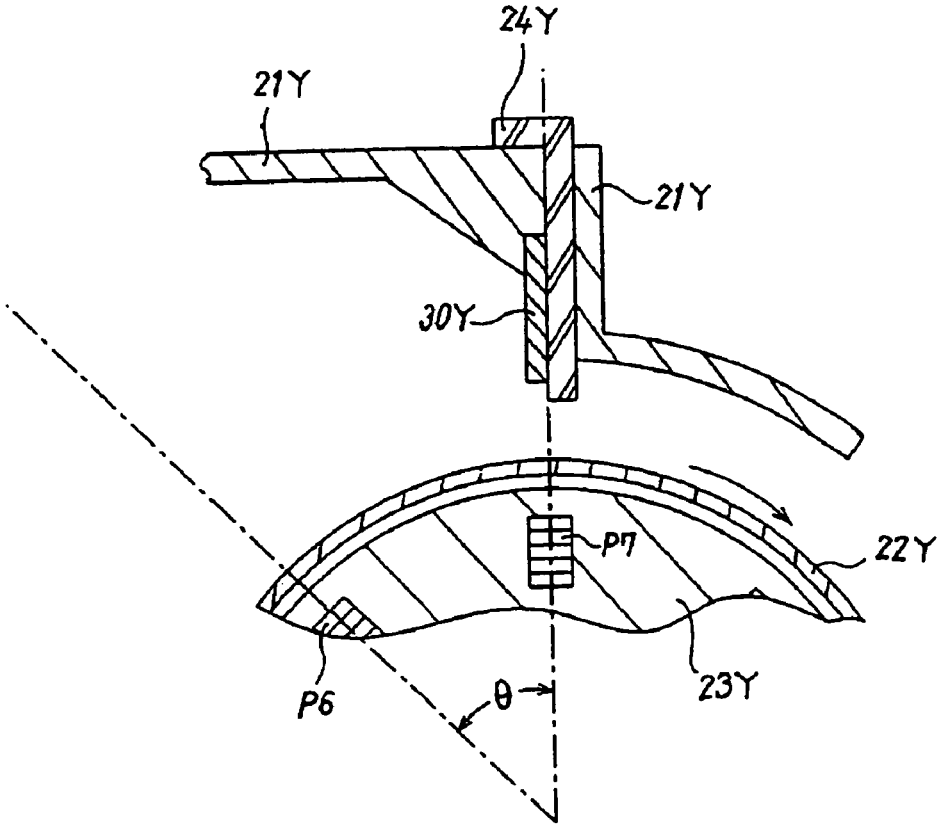
FIG. 5 is an enlarged constitution view of a doctor blade of the developing unit and a portion thereabout.

FIG. 5 is an enlarged constitution view of a doctor blade 24Y and a portion thereabout. In FIG. 5, the doctor magnetic pole P7 and the upstream adjacent magnetic pole P6 adjacent to the doctor magnetic pole on the upstream side thereof meet the following relative position relationship. That is, the both magnetic poles meet a relative position relationship where their center points have been deviated from each other by an angle θ along a direction of rotational movement of the sleeve. The doctor blade 24Y is disposed such that a back surface (a face abutting on two-component developer) is positioned on the center line of the doctor magnetic pole P7 in the rotational direction of the sleeve. A magnetic member 30Y made of magnetic material is fixed on the back surface of the doctor blade 24Y.

The present inventors have made experiment for examining a relationship between the magnitude or shape of magnetic field generated between the upstream adjacent magnetic pole P6 and the doctor magnetic pole P7, and the degree of the degradation progress of the toner. Specifically, five kinds of developing unit testing machines which meet conditions 1 to 5 shown in the following Table 1 have been made on an experimental basis. In the respective conditions, the degrees of degradation progress of toner have been examined.

TABLE 1

| | Upstream adjacent magnetic pole P6 | Doctor magnetic pole P7 |
|---|---|---|
| Condition 1 | Standard product | Standard product |
| Condition 2 | Standard product | Peak value of magnetic flux density in normal direction is lowered from standard product by 20 milliTesla |
| Condition 3 | Peak value of magnetic flux density in normal direction is lowered from standard product by 20 milliTesla | Standard product |
| Condition 4 | Standard product | chamfered work product |
| Condition 5 | Peak value of magnetic flux density in normal direction is lowered from standard product by 20 milliTesla | chamfered work product |

In the condition 1 in Table 1, as the upstream adjacent magnet having the upstream adjacent magnetic pole P6 and the doctor magnet having the doctor magnetic pole P7, standard products similar to ones used in the conventional developing unit (29Y) was used. The standard product of the doctor magnet was set that its width corresponding to a length thereof in a sleeve rotation direction and its height corresponding to a length thereof in a sleeve normal direction (hereinafter, simply "normal direction") were 6.6 millimeters and 5.5 millimeters, respectively.

In the condition 2, as the doctor magnet (having the doctor magnetic pole P7), one shorter than a standard product by 1 millimeter (height=4.5 millimeters) was used. A peak value of the magnetic flux density generated from the doctor magnet in the normal direction on the surface of the sleeve was smaller than that obtained by the standard product by 20 milliTesla.

In the condition 3, as the upstream adjacent magnet (having the upstream adjacent magnetic pole P6), one smaller in height than the standard product by 1 millimeter was used. The peak value of the magnetic flux density generated by the upstream adjacent magnet on the surface of the sleeve in the normal direction was smaller than that obtained by the standard product by 20 milliTesla.

Figure 6:
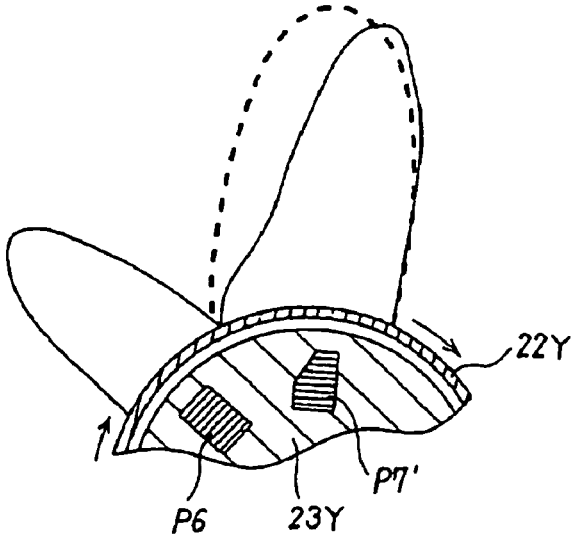
FIG. 6 is an illustrative diagram of portions of a developing sleeve and a magnet roller of the developing unit and a state of magnetic field on a surface of the sleeve.

In the condition 4, as the doctor magnet, one which was larger in height than the standard product by 2.0 millimeters and whose ridge corner portion defined by a face thereof facing the sleeve surface and a face thereof facing the upstream adjacent magnet, as shown in FIG. 6, was chamfered was used. The width of the face of the doctor magnet facing the sleeve surface is set to 4.0 millimeters. In the doctor magnetic pole P7' of the doctor magnet with such a constitution, a peak value of the magnetic flux density on the sleeve surface in the normal direction was substantially equal to a peak value of the magnetic flux density of the standard product shown with a dotted line in FIG. 6 in the normal direction, as shown in FIG. 6. The width of the magnetic flux density in the normal direction in the vicinity of a distal end thereof in the doctor magnet meeting the condition 4 was narrower than that in the standard product, and the position of the peak of the magnetic flux density in the former was moved to the downstream side in the rotational direction of the sleeve relative to that in the latter.

In the condition 5, as the upstream adjacent magnet, one meeting the condition 3 is used and as the doctor magnet, one meeting the condition 4 was used.

Figure 7:
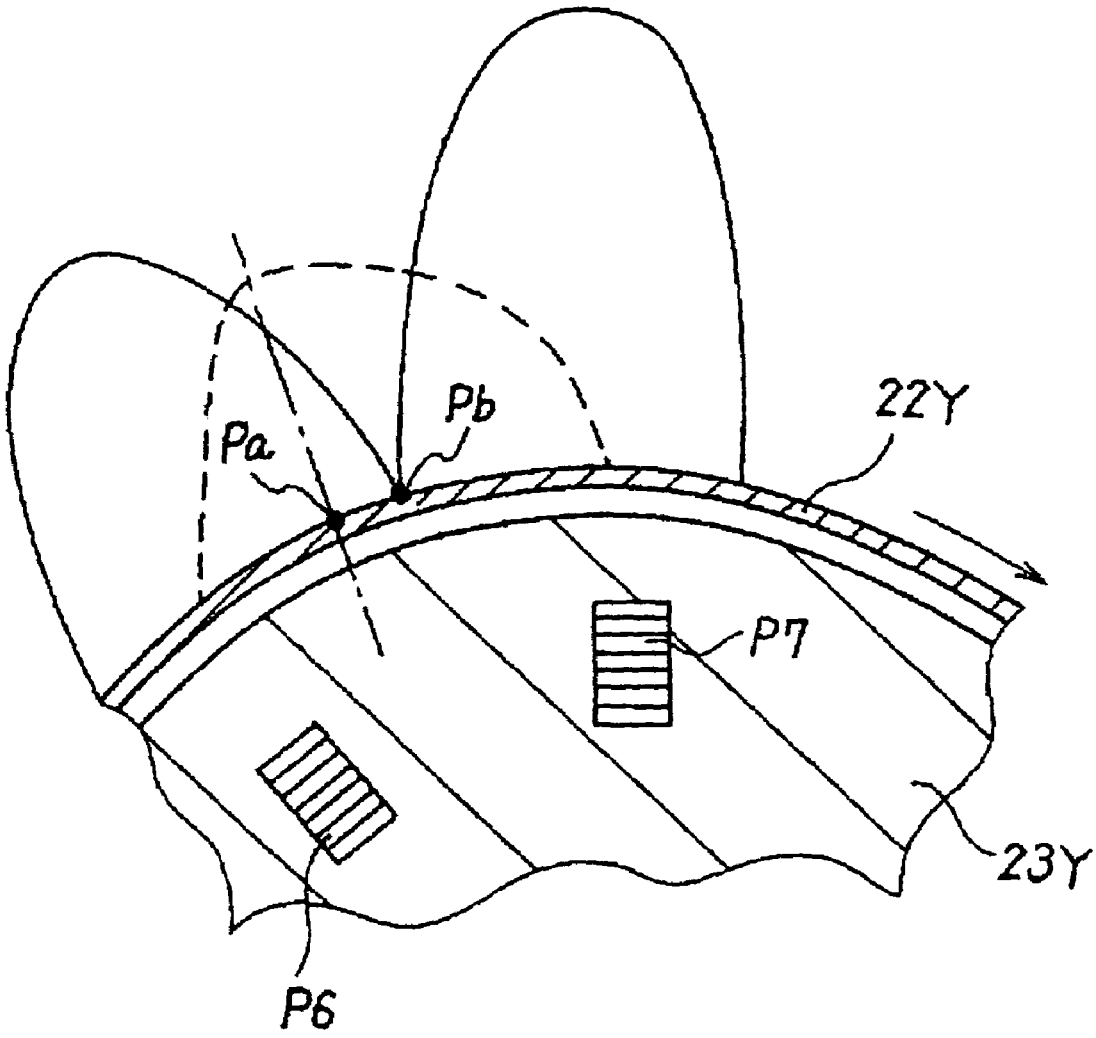
FIG. 7 is an illustrative diagram of portions of a developing sleeve and a magnet roller of a developing unit of a comparative example and a state of magnetic field on a surface of the sleeve.
Figure 8:
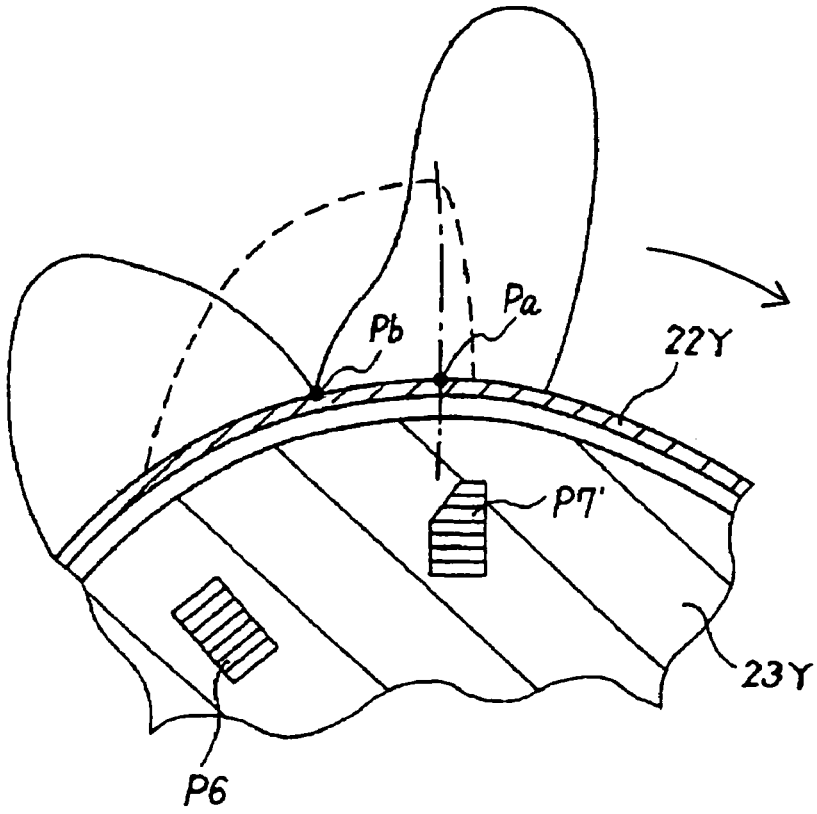
FIG. 8 is an illustrative diagram of portions of a developing sleeve and a magnet roller of a developing unit according to an embodiment and a state of magnetic field on a surface of the sleeve.

According to the order of the conditions 1, 2, 3, 4, and 5, a peak point Pa of magnetic flux density in the normal direction between the upstream adjacent magnetic pole P6 and the doctor magnetic pole P7 was gradually moved. In the conditions 1 and 2 among those conditions, the peak point Pa was a point (an inflection point) Pb where the magnetic flux density in the normal direction formed on the sleeve surface by the upstream adjacent magnetic pole P6 and the doctor magnetic pole P7 became zero, as shown in FIG. 7. On the other hand, in the conditions of 3 to 5, the peak point Pa was positioned on the downstream side of the inflection point Pb in the rotational direction of the sleeve, as shown in FIG. 8. In FIG. 7 and FIG. 8, magnetic flux densities in the normal direction and in the tangential direction are indicated with a solid line and a dotted line, respectively.

A magnetic flux density ratio which is a value obtained by dividing the value of the peak point Pa by the peak value of the magnetic flux density in the normal direction took 78, 55, 60, 50, and 35% in the conditions 1, 2, 3, 4, and 5, respectively.

Items explained below were investigated in five kinds of developing unit testing machines meeting the conditions 1 to 5, respectively.

Figure 1:
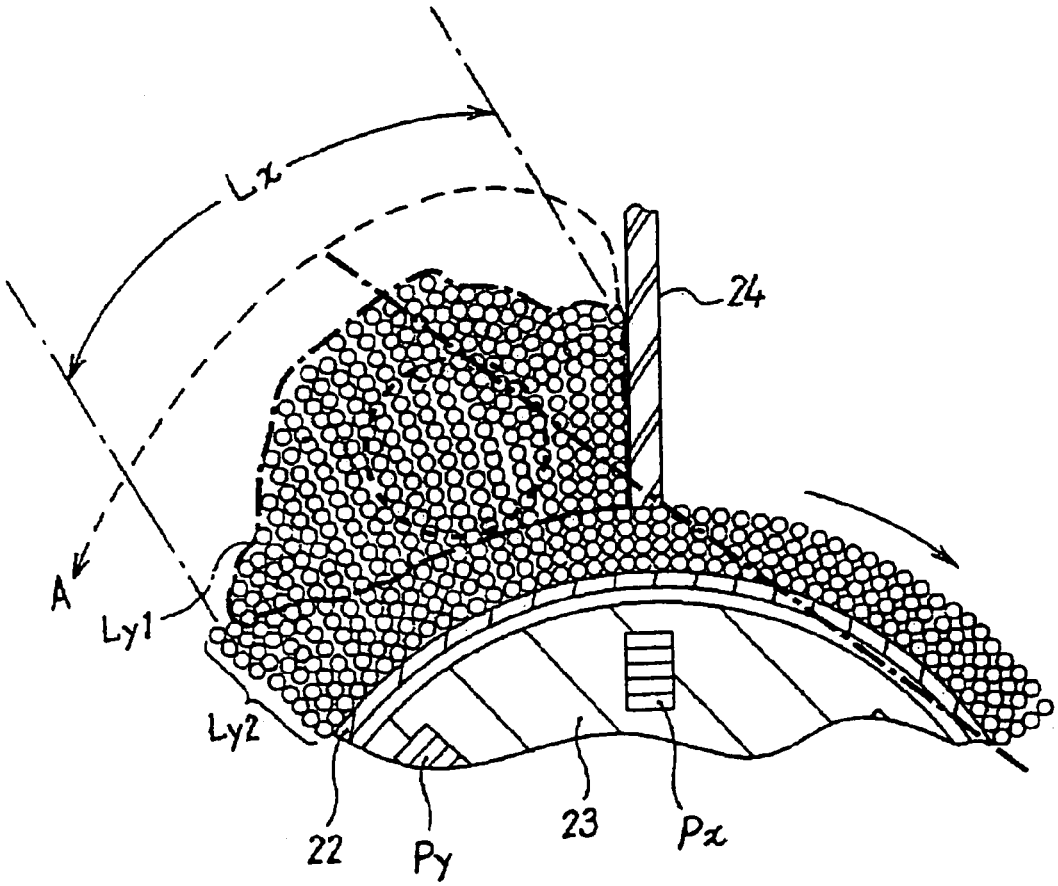
FIG.1 PRIOR ART
FIG. 1 is an enlarged view of a partial constitution of a conventional developing unit of a two-component developing system.
Figure 9:
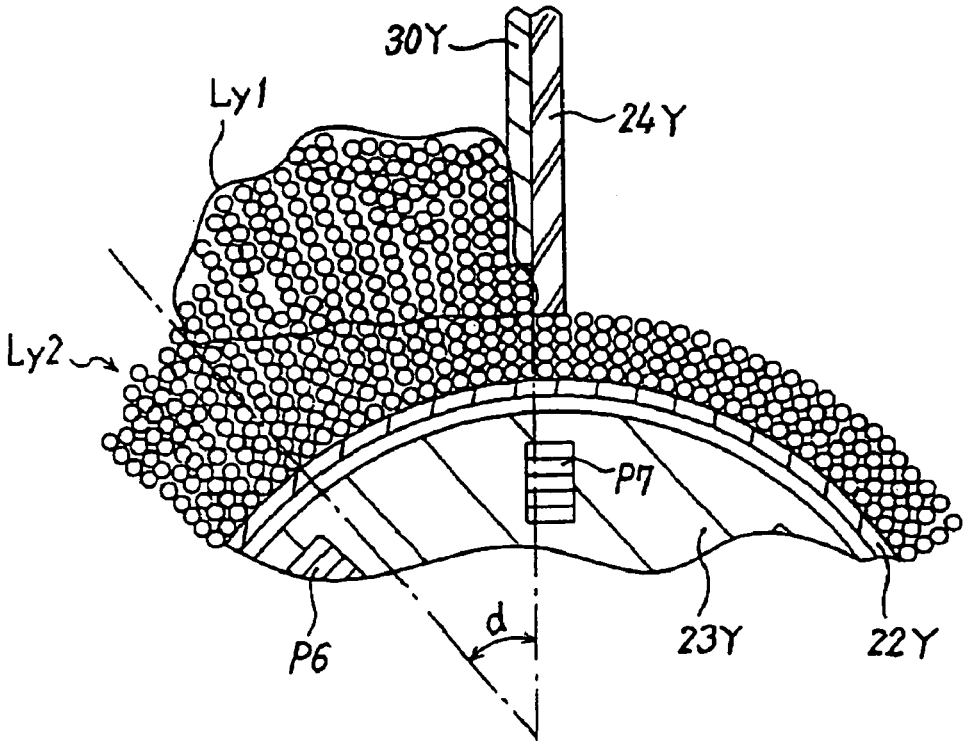
FIG. 9 is a diagram for explaining an angle d formed by a distal end edge of a rear face of the doctor blade and a rear end of an immovable layer.

Angle d was measured in order to grasp the length Lx of such an immovable layer Ly1 as shown in FIG. 1, which was formed on the upstream side of the doctor blade (24Y) in the rotational direction of the sleeve. Specifically, printer testing machines in which respective developing unit testing machines were individually set were prepared. While a reference image was printed out in by each machine, behavior of a magnetic brush around the doctor blade (24Y) was photographed by a high speed camera connected to a telescopic microscope (Model SZ-STB1 by Olympus Corporation). After binarization was performed on digital image data obtained by photographing, an angle d formed by a distal end edge of a back surface of the doctor blade 24Y and a rear end (the most upstream side) of the immovable layer Ly1 was measured as shown in FIG. 9. The diameters of the developing sleeves 22Y were the same in all the developing unit testing machines. An angle θ formed by the center point of the upstream adjacent magnet in widthwise direction and the center point of the doctor magnet in widthwise direction was 45°.

Figure 10:
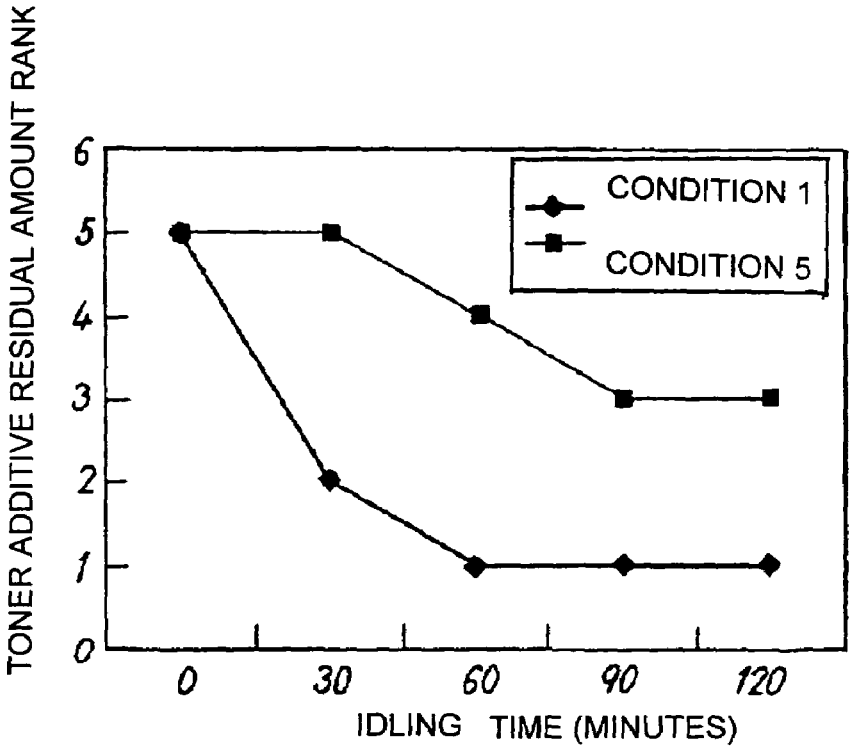
FIG. 10 is a graph of a relationship between an idling operation time and an additive residual amount rank in two developing unit test machines respectively provided with conditions 1 and 5.

While each developing unit testing machine where two-component developer was set were continuously operated in an idling manner, the two-component developer was taken out of the developing unit testing machine for each thirty minutes. The developer was separated into magnetic carrier and toner, a surface of the toner was observed by a scanning electron microscope (FE-SEM), and the additive remaining on the surface was determined in an imaging manner. The additive residual amount rank was classified to five stages according to the residual amount of the additive. A state where the additive was not adhered to the surface of the toner all was defined as additive residual amount rank 1. A state where the additive was reduced to one half of the initial amount was defined as additive residual amount rank 3. It was found that, when the additive residual amount rank was 3 or more, background dirt was not caused at a replenishing time of toner from the toner bottle to the developing unit. It was also found that, if the additive residual amount rank was 2 or less, background dirt was caused due to inferiority of a rising performance of toner charging at a replenishing time of toner. For reference, relationships between the idling operation time and the additive residual amount rank in two developing unit testing machines meeting the conditions 1 and 5 are shown in FIG. 10.

Regarding each developing unit testing machine, a conveying screw or the like was separated from a driving and transmitting system and only the developing sleeve (22Y) was rotated by the developing motor, where a driving torque of the developing motor was measured. A torque rising generated by other rotating members inside the developing unit could be removed by rotating only the developing sleeve. Thereby, only load around the developing sleeve could be reflected to the torque. As regards measurement of the torque, an output value from a strain gauge (by Kyowa Electronic Instruments) was monitored by a data logger and an average of dynamic torque data for 20 seconds was defined as the measurement value.

Regarding each developing unit testing machine, behavior of a magnetic brush in a course from a peripheral region of the doctor blade (24Y) to the developing region was photographed by a high speed camera connected to a telescopic microscope (Model SZ-STB1 by Olympus Corporation). Then, change of the amount of the magnetic brush conveyed to the developing region was observed.

Regarding each developing unit testing machine, a rising performance of toner charging in two-component developer in a course from pumping of the developer conducted by the pumping magnetic pole (P4 in FIG. 4) to the developing region was investigated. Specifically, after toner was mixed to fresh magnetic carrier in a predetermined concentration, the mixed material was weakly stirred by a tubular mixer 1 for only one minute, so that weakly stirred two-component developer was prepared. After this developer was set in each developing unit testing machine and the testing machine was operated for a short time, the two-component developer in the developing region was picked. Toner was separated from the picked two-component developer and its charge quantity per mass (Q/M) was measured. By using, as a sample to be examined, the toner in the two-component developer obtained by setting the weakly stirred two-component developer in the developing unit testing machine to operate the machine for the short time, a triboelectric charging quantity of toner when the two-component developer passes through the restricting position defined by the doctor blade (24Y) could be measured with a high precision. As regards each developing unit testing machine, measurement was conducted under both a high temperature and high moisture environment (30° C. and 90%) and a low temperature and low moisture environment (10° C. and 15%). A case that the increase amount of Q/M was less than 4 μc/g and a case that it was equal to or more than 4 μc/g were marked by "x" indicating that the rising performance of toner charging was poor and "O" indicating that it was excellent. The results of respective items are collectively shown in the following Table 2. In Table 2, the additive residual amount rank of toner obtained after 30 minutes passes from start of the idling operation is shown.

TABLE 2

| | Condition 1 | Condition 2 | Condition 3 | Condition 4 | Condition 5 |
|---|---|---|---|---|---|
| Position of peak point Pa to boundary line Lc: upstream side: downstream side | Upstream side | Upstream side | Downstream side | Downstream side | Downstream side |
| Magnetic flux density ratio (tangential direction/normal direction) (%) | 78 | 55 | 60 | 50 | 35 |
| Angle θ | 45 | 45 | 45 | 45 | 45 |
| Angle d | 30 | 21 | 18 | 15 | 10 |
| d/θ | 0.67 | 0.44 | 0.40 | 0.33 | 0.22 |
| Additive residual amount rank | 1 | 3 | 2.5 | 3 | 4 |
| Developing motor driving torque (N · cm) | 1.6 G | 1.3 G | 1.3 G | 1 G | 0.7 G |
| Developer conveyance stability to developing region | ○ | x | ○ | ○ | ○ |
| Rising performance of toner charging | ○ | x | ○ | ○ | ○ |

*G denotes gravitational acceleration in Table

As shown in FIG. 2, the angle d representing the length, in the circumferential direction, of the immovable layer formed on the upstream side of the doctor blade (24Y) in the rotational direction of the sleeve becomes smaller in the order of the conditions 1, 2, 3, 4, and 5. In the condition 1, namely, in a condition that standard products were respectively used as the upstream adjacent magnetic pole P6 and the doctor magnetic pole P7, the additive residual amount rank of toner was 1. This indicates a fact that the toner was adhered with the amount of the additive in an initial state thereof at a starting time of the idling operation of the developing unit testing machine but after the idling operation of the testing machine for 30 minutes, the rank of the additive residual amount was urgently lowered to the rank 1 where the toner was not adhered with the additive at all. It should be understood that degradation of the toner progressed in an extremely rapid manner.

In the condition 2, namely, in such a condition that the peak value of the magnetic flux density of the doctor magnetic pole P7 in the normal direction was reduced by 20 milliTesla as compared with that of the standard product, the developing motor driving torque could be reduced by 0.3 G (N·cm) as compared with that in the condition 1. Thereby, the additive residual amount of toner after 30 minutes passed from start of the idling operation could be increased from the rank 1 up to the rank 3. However, the developer conveyance stability was poor and the amount of the two-component developer conveyed so as to pass through the doctor gap into the developing region was fluctuated largely. Accordingly, when the developing unit testing machine meeting the condition 2 was set in a printer and an image was printed out, uneven density occurred in a threading direction of a paper. Particularly, when a color image was printed out, disturbance of color tone appeared noticeably due to the uneven density. The reason why such uneven density occurs is because the amount of a magnetic brush conveyed to a doctor gap becomes insufficient sometimes due to shortage of intensity of magnetic field in the vicinity of a doctor blade. When the amount of the magnetic brush conveyed to the doctor brush is insufficient, of course, triboelectric charging performance of toner deteriorates. Therefore, evaluation about the rising performance of toner charging becomes poor "x". In these circumstances, such a face is understood that, when the peak value of the magnetic flux density of the doctor magnetic pole P7 in the normal direction is lowered, degradation of toner can be suppressed but an image with stable density cannot be formed. Accordingly, it is not the best plan to suppress degradation of toner by simply weakening the magnetic flux density in the normal direction generated by the doctor magnetic pole P7.

In the condition 3, namely, in such a condition that the peak value of the magnetic flux density of the upstream adjacent magnetic pole P6 in the normal direction was reduced by 20 milliTesla as compared with that of the standard product, the developing motor driving torque could be reduced by 0.3 G (N·cm) as compared with that in the condition 1. In addition, excellent developer conveyance stability and excellent rising performance of toner charging could be obtained. The reason whey such excellent results could be obtained will be considered as follows. That is, a magnetic brush on a surface of the developing sleeve (22Y) is formed in a shape extending along magnetic flux in the tangential direction rather than magnetic flux in the normal direction. Therefore, as the magnetic flux density in the tangential direction between the upstream adjacent magnetic pole P6 and the doctor magnetic pole P7 is lowered on the upstream side of the doctor blade (24Y) in the sleeve rotational direction, the size of the immovable layer becomes larger. However, the magnetic flux density is lowered excessively, the amount of the magnetic brush conveyed to the doctor gap often becomes insufficient, which makes the developer conveyance amount to the developing region unstable and deteriorates the rising performance of toner. In order to make the size of the immovable layer small while suppressing such a shortage, the following process may be performed. That is, while the size of the immovable layer is made small by lowering the magnetic flux density in the normal direction wholly, the peak point Pa of the magnetic flux density is positioned near to the doctor blade (24Y) as far as possible so that the necessary amount of the developer is secured in the vicinity of the doctor gap. As understood from the comparison of FIG. 7 and FIG. 8 previously described, the peak point Pa in the condition 3 is positioned nearer to the doctor gap than that in the condition 2. Therefore, the necessary amount of the developer can be secured in the vicinity of the doctor gap in the condition 3. As shown in Table 2, however, the rank of the additive residual amount is 2.5. Background dirt will occur slightly at a replenishing time of toner in this rank. The rank of the additive residual amount is 3 in the condition 2, but it deteriorates to 2 in the condition 3. This is because stress for triboelectric charging is not applied to toner at the doctor gap in the condition 3.

In the condition 4, namely, in such a condition that the doctor blade was chamfered, the developer motor driving torque could be reduced by 0.6 G (N·cm) as compared with that in the condition 1. In addition, excellent results about the developer conveyance stability and the rising performance of toner charging could be obtained. Further, the rank 3 where the additive residual amount of toner does not cause background dirt was realized. The reason why the rank 3 was realized will be considered as follows. That is, the angle d in the condition 3 was 18 degrees, but the angle d in the condition 4 was 15 degrees. This means that the length (Lx) of the immovable layer in the circumferential direction (in the sleeve rotational direction) in the condition 4 became smaller than that in the condition 3. As the length (Ls) in the condition 4 was reduced, stress due to rubbing between the immovable layer and the following rotation layer was also reduced so the additive residual amount rank was raised. However, if the angle d becomes small, there is a possibility that the staying amount of the developer is reduced on the upstream side of the doctor blade (24Y), and the developer conveyance stability and the rising performance of toner charging deteriorate. In the condition 4, however, the peak point Pa of the magnetic flux density in the tangential direction between the upstream adjacent magnetic pole P6 and the doctor magnetic pole P7' is positioned on the downstream side in the sleeve rotational direction as compared with that in the condition 3. Thereby, it is considered that, while the staying amount of the developer on the upstream side was reduced, the necessary amount of the two-component developer in the vicinity of the doctor gap was secured so that the excellent developer conveyance stability and the excellent rising performance of toner charging were realized.

In the condition 5, namely, in such a condition that the upstream adjacent magnet meeting the condition 3 and the doctor magnet meeting the condition 4 were used, while the magnetic flux density in the tangential direction between the upstream adjacent magnetic pole P6 and the doctor magnetic pole P7 was reduced, the peak point Pa was caused to further approach to the doctor gap. Thereby, while excellent developer conveyance stability and excellent rising performance of toner charging were realized, the additive residual amount of toner could be improved up to the rank 4.

From the results, it should be understood that degradation of toner can further be suppressed by chamfering a ridge corner defined by the face of the doctor magnet, serving as the restricting magnet, facing the developing sleeve (22Y) and the face thereof facing the upstream adjacent magnet. It should be understood that degradation of toner can further be suppressed by positioning the peak point Pa of the magnetic flux density in the tangential direction (in a direction parallel to the sleeve surface) between the doctor magnetic pole P7 and the upstream adjacent magnetic pole P6 on the downstream side of the normal line LY in the sleeve rotational direction. Furthermore, as understood from the test for the rising performance of toner charging, the stability of toner charging can be effectively achieved without applying stress on toner excessively by performing chamfering or positioning the peak point Pa on the upstream side of the normal or orthogonal line LY.

From comparison of the condition 3, and condition 4 and condition 5 shown in Table 1 or Table 2 previously described, it is desirable that the value of the peak point Pa is equal to or less than 50% of the peak value of the magnetic flux density of the doctor magnetic pole P7 in the normal direction. By employing such a constitution, sufficient rising performance of toner charging can be realize without applying excessive stress on the toner.

In the above test, the condition of the magnetic field about the doctor blade (24Y) was changed by adjusting the shape or size of each magnet in the magnet roller 23. However, the condition of the magnetic field may be changed by adjusting the material for the magnet or arrangement angle of the magnet.

The present inventors tested the degree of degradation progress of the magnetic carrier in the respective conditions described above. Specifically, in the printer testing machine set with each developing unit testing machine, printing-out was conducted at an image area ratio of 50% for 40 hours while toner supply was being conducted such that the toner density of the two-component developer fallen in a predetermined range. While such an operation was conducted, the two-component developer was taken out from the developing unit testing machine at predetermined intervals. After toner was removed from the two-component developer, the developer was mixed with fresh toner to be stirred by a roll mill, and the charging quantity of tone was measured. Since the toner is fresh one which has not been degraded, the charging quantity of the toner varies according to the capacity of the magnetic carrier to charge the toner. That is, as degradation of toner progresses, the measured value of the charging quantity of toner becomes lower. The ratio of the measured value to an average charging quantity of toner obtained by stirring fresh two-component developer comprising fresh magnetic carrier and fresh toner combined by a roll mill was obtained with percentage and the charging performance of the magnetic carrier to toner to was evaluated. In this connection, it is desirable that lowering of the charging performance to toner is suppressed within a range of 10% or less.

Figure 11:
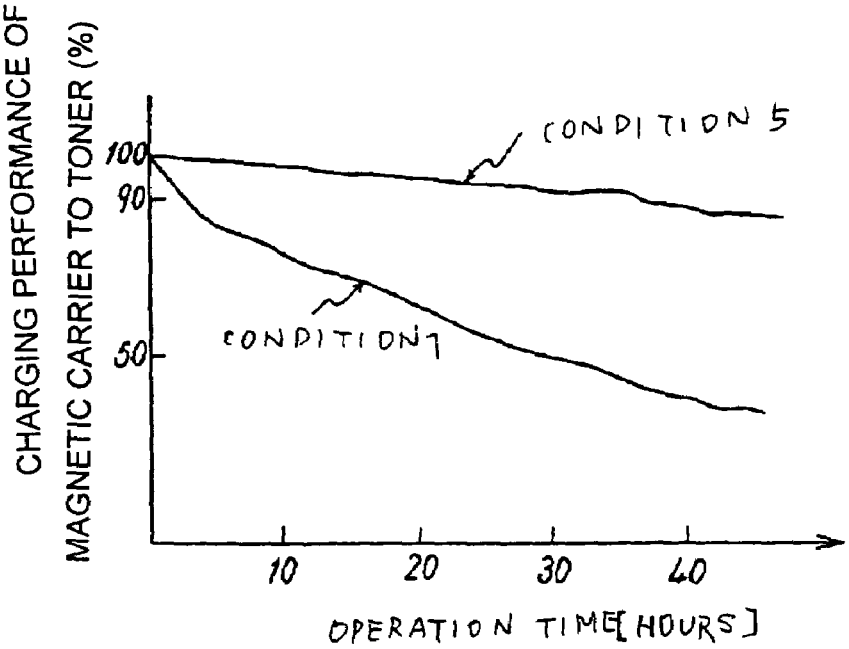
FIG. 11 is a graph of degradation degrees of magnetic carrier in the condition 1 and the condition 5.

FIG. 11 is a graph of degradation degrees of the magnetic carriers in the condition 1 and condition 5. As shown in FIG. 11, in the condition 1, after 10 hours elapsed from operation start, the charging performance to toner was already lowered down to about 80% or so. That is, the charging performance was lowered about 20%. On the other hand, in the condition 5, even after 40 hours elapsed from operation start, the charging performance to toner of the 90% or more could be maintained. Though not shown in FIG. 11, the charging performance to toner after 40 hours elapsed was maintained in the range of 90% or more even in the condition 4. Considering this result and the angle d or d/θ shown in Table 2, it will be desirable that the angle d is set so as to meet [$d \leqq \theta/3$].

The developing motor driving torque shown in Table 2 represents values obtained by using the developing sleeve (22Y) with a diameter of 25 millimeters. When a developing sleeve with a smaller diameter is used, the value of torque is also reduced. The size (angle d) of the immovable layer in the sleeve rotational direction can also be reduced by expanding the angle defined by the edge portion of the back surface of the doctor blade (24) and the upstream adjacent magnetic pole P6 to a certain extent. However, by employing such a constitution, fluctuation of the amount of the two-component developer restrained by the magnetic field obtained by the doctor blade (24Y) and the upstream adjacent magnetic pole P6 becomes large. As a result, unstableness of the conveying amount of the developer to the developing region or unstableness of the charging quantity of toner are caused, which is undesirable.

In view of the test results described above, in the printer according to this embodiment, a developing unit meeting the condition 4 or 5 is used as the developing unit for each color (20Y, 20M, 20M, 20*k*).

The tests explained above were conducted using spherical toner particles manufactured by a polymerization process as all Y toner. An average circularity and a volume average particle diameter were 0.98 micrometer and 5.2 micrometers, respectively.

In the tests explained above, toner obtained by adding additive comprising silica of 0.7 parts by weight and titanium oxide of 0.3 parts by weight to toner particles was used. Though it is thought that an addition amount of silica is set to 1 weight part or more in order to reduce a physical bonding force between magnetic carriers and toner particles to further increase the developing efficiency, such setting is undesirable from the following point of view. That is, a margin to an environmental fluctuation according to change of the charging quantity is lowed or a drawing amount of magnetic carrier in a time elapsing manner (the amount of the magnetic carrier passing through the doctor blade per unit) is lowered.

As previously shown in FIG. 5, in the developing unit of the printer according to this embodiment, the magnetic member made of magnetic material is fixed to a contacting face of the doctor blade (24) serving as the restricting member, which comes in contact with the two-component developer. This is because the present inventors have found the phenomenon described below on the basis of repeated investigations. That is, in the conventional developing unit (20), as described above, a relatively large immovable layer is formed on an upstream side of the doctor blade (24) in the sleeve rotational direction. Degradation of toner or magnetic carrier was accelerated, but it was found that the immovable layer provided an advantageous condition. Since the relatively large immovable layer was formed, a stable amount of the two-component developer was conveyed to the doctor gap so that the conveyance amount of the developer to the developing region or the triboelectric chargeability in the doctor gap was stabilized. When the size of the immovable layer becomes small in the circumferential direction, the amount of the two-component developer conveyed to the doctor gap becomes unstable correspondingly, and the conveying performance of the developer to the developing region and the triboelectric chargeability becomes unstable. Therefore, the magnetic member 30 was fixed to the doctor blade (24). With such a constitution, it is made possible to extend lines of magnetic force from the doctor magnetic pole P7 concentrically toward the doctor blade (24) to stay the two-component developer concentrically in the vicinity of the doctor blade (24). Fluctuation of the two-component developer positioned on the upstream side of the staying position can be absorbed by the staying developer so that a stable amount of the two-component developer can be fed into the doctor gap. The example where the magnetic member 30Y was fixed to the doctor blade (24) was explained in the embodiment. However, magnetic material can be used wholly or partially for the doctor blade (24), where a similar advantage or effect can be obtained.

In case that the magnetic member 30Y is fixed to the doctor blade (24) or a magnetic portion made of magnetic material is provided in the doctor blade (24), it is desirable that the following consideration is made to the magnetic member 30 or the magnetic portion. That is, an end portion of the magnetic member 30 or the magnetic portion on an opposite side of the developing sleeve (22) is covered with non-magnetic material such that the two-component developer on the sleeve does not come in direct contact with the end portion. As previously shown in FIG. 5, in the developing unit 20 in this printer, an end portion of the magnetic member 30Y on an opposite side of the developing sleeve is covered by utilizing a portion of the developing sleeve 21Y made from non-magnetic material. By performing such covering, torque rising due to that the two-component developer is magnetized on to a back surface side (a developer abutting face side) of the doctor blade (24) can be suppressed. Specifically, the magnetic member 30Y or the magnetic portion is magnetically polarized due to influence of the magnetic force of the doctor magnetic pole P7. For example, when an end portion of the doctor magnetic pole P7 facing the developing sleeve (22) is N pole, an end portion of the magnetic member 30Y or the magnetic portion facing the developing sleeve (22) is polarized to S pole. On the other hand, an end portion of the magnetic member 30Y or the magnetic portion on the opposite side of the developing sleeve (22) is polarized to N pole to be magnetized. Two-component developer restrained in the vicinity of the opposite side end portion of the magnetic member or the magnetic portion imparts load on the developing motor via two-component developer positioned below the restrained two-component developer and rotated according to rotation of the sleeve surface to pass through the doctor blade. Therefore, the magnetized opposite end portion of the magnetic member 30Y or the magnetic portion is covered with non-magnetic material so that the two-component developer is prevented from being restricted magnetically.

It is desirable that a magnet roller constituted such that the strength of the magnetic force of each magnetic pole thereof has a value where the density p of two-component developer present on the upstream side of the doctor blade (24) is made smaller than the compression density pT of the two-component developer is used as the magnet roller (23). This is because two-component developer with an excessively high density lowers the granularity on an output image remarkably. In this connection, the two-component developer present on the upstream side of the doctor blade (24) specifically means two-component developer attracted toward the surface of the developing sleeve (22) by magnetic field between the doctor magnetic pole P7 serving as the restricting magnetic pole and the upstream adjacent magnetic pole P6. The density ρ of such two-component developer or the compression density ρ T of the two-component developer used in this printer can be measured in the following manner. That is, a sectional area of two-component developer on the developing sleeve (22) present on the upstream side of the doctor blade (24) is first obtained on the basis of a photographed image by the telescopic microscope (Model SZ-STB1 by Olympus Corporation). Such two-component developer is picked from the surface of the developing sleeve (22) and its density is obtained on the basis of JIS method. The value obtained is the density ρ. Two-component developer from the developer containing chamber is then picked and is filled in a test tube in such a manner that the developer is cut off at an opening position of the test tube. Tapping is performed twice such that a bottom of the test tube is hit on a desk. When a bulk of the two-component developer in the test tube is reduced by the tapping, two-component developer is additionally filled in the test tube so as to correspond to the reduced amount in the cutting-off manner, and tapping is further conducted twice. The combination of the cutting-off filling and the two-time tapping can be conducted up to ten times. When developer reduction after tapping is not found before the combination has been conducted ten times, the density of the two-component developer at that time is determined as the compression density ρT. When further developer reduction is found even after the combination has been conducted ten times, the density at that time is determined as the compression density ρT.

Regarding the magnet roller (23) according to the present invention, it is desirable that at least one conveying magnetic pole (the first conveying magnetic pole P5 in this embodiment) is provided between the pumping magnetic pole P4 and the upstream adjacent magnetic pole P6 in the sleeve rotational direction, as previously shown in FIG. 4. This conveying magnetic pole means a magnetic pole for constraining two-component developer on the sleeve surface between the pumping magnetic pole and the upstream adjacent magnetic pole to convey the same. The reason why it is desirable to provide such a conveying magnetic pole is as follows. That is, as described above, when the size of the immovable layer in the sleeve rotational direction is made small, stress acting on toner or magnetic carrier can be reduced effectively, but the feeding amount of the two-component developer into the doctor gap is easily made unstable. As previously described, the magnetic member (30Y) is fixed to the doctor blade (24) in order to suppress unstableness to the conveying amount of the developer to the developing region or unstableness of the quantity of toner charging due to the unstableness of the feeding amount. However, the unstableness of the conveying amount of the developer or the unstableness of the charging quantity of toner largely depends on the unstableness of the pumping amount of developer on to the surface of the developing sleeve (22). Even if the magnetic member (30Y) is provided for securing a certain amount of two-component developer in the vicinity of the doctor blade (24), when the amount of two-component developer fed from the upstream side thereof is largely fluctuated, unstableness of the conveying amount of developer or the charging quantity of toner may be caused. Therefore, at least one conveying magnetic pole is provided between the pumping magnetic pole and the upstream adjacent magnetic pole. By employing such a constitution, a large fluctuation of the pumping amount of the two-component developer fed from the developer containing chamber can be absorbed in two-component developer constrained on the sleeve surface by the conveying magnetic pole (the first conveying magnetic pole P5 in this embodiment), and the two-component developer is then fed in the vicinity of doctor blade (24). Thereby, unstableness of the conveying amount of developer or the charging quantity of toner due to that the size of the immovable layer in the sleeve rotational direction is made small can further be suppressed reliably.

This printer instructs a user to use toners meeting all the following conditions (a) to (d) as Y, M, C, and K toners.

(a) Each toner is manufactured by polymerization method using denatured polyester resin as base material.

(b) A weight average particle diameter of each toner is in a range of 4.0 to 8.0 micrometers, and a grain size distribution (volume average particle diameter Dv/number average particle diameter Dn) is in a range of 1.05 to less than 1.30.

(c) An average circularity is in a range of 0.90 to less than 1.00.

The printer instruct a user to use magnetic carrier meeting the following condition (d) as magnetic carrier used in two-component developer.

(d) An average particle diameter of the magnetic carrier is in a range of 25 to 55 micrometers.

A method for instructing a user to use such toner and such magnetic carrier may include packaging of toner meeting the above conditions (a) to (c) and magnetic carrier meeting the condition (d) together with a printer to make shipping. Further, for example, such a method can be employed that product numbers or trade names of such toner and such magnetic carrier is written clearly on a printer main body or an operation manual thereof. Alternatively, for example, such a method can be adopted that the product numbers, the trade names or the like are notified to a user via a document, electronic data or the like. In addition, the toner bottle serving as a toner containing unit and containing such toner may be shipped in as state that it has been set in a printer main body. In this printer, all of these methods are employed, but one thereof may be adopted in this invention.

The reason why toner meeting the above condition (a) is specified as the toner to be used is as follows. That is, the present inventors produced two kinds of toners using base materials different from each other by the polymerization process. Specifically, urea denatured polyester (750 parts) and non-denatured polyester (250 parts) were dissolved and mixed in mixed solution of ethyl acetate and methyl ethyl ketone (MEK) of 1:1 to obtain toner-binder solution. The solution was pressure-reduced and dried to isolate toner-binder as toner A. On the other hand, 2 mole of bisphenol A ethylene oxide additional compound (354 parts) and isophthalic acid (166 parts) were poly-condensed using catalyst of dibutyltin oxide (2 parts) to obtain toner B. Using the toner A and the toner B, character images were printed out in the condition 4 or 5. Regarding the character images obtained, ranks about transfer dust or reversing were evaluated. From the evaluation, it was clearly understood that the toner A could further suppress transfer dust and reverse print (transposition reverse) as compared with the toner B. It is desirable that toner produced by the polymerization process using denature polyester as base material is used. By employing such a process, the transfer dust and/or the print can be suppressed to an inconspicuous level.

One example of a method for producing toner according to the polymerization process using denatured polyester resin as base material is as follows. That is, polyol (1) and polycarboxylic acid. (2) are heated in a range of 150 to 280° C. under existence of known esterificated catalyst such as tetra butoxy titanate or dibutyltin oxide, where water produced is diluted out while pressure is being reduced as necessary, thereby obtaining polyester with hydroxyl group. The polyester is then reacted with polyisocyanate (3) at a temperature of 40 to 140° C. to pre-polymer (A) with isocyanate group. Further, the pre-polymer is reacted with amines (B) at a temperature of 0 to 140° C. to obtain denatured polyester (i). When the reaction of the polyisocyanate (3) is conducted, or when the pre-polymer (A) and the amines (B) are reacted with each other, solvent may be used as necessary. Usable solvents include aromatic solvents (toluene, xylene, etc.), ketones (acetone, MEK, methyl isobutyl ketone, etc.), esters (ethyl acetate, etc.), amides (dimethylformamide, dimethylacetamide, etc.), ether (tetrahydrofuran, etc.), and the like, which are inert to the isocyanate. When polyester (ii) which has not been denatured with urea coupling is used together, such a process may be employed that polyester is produced according to a method similar to production of polyester with hydroxyl group and it is dissolved and mixed in a solution after completion of reaction of the denatured polyester (i).

Aqueous medium using such a toner producing method may include water alone, but it may be used together with solvent mixable with water. The mixable solvents include alcohol (methanol, isopropanol, ethylene glycol, etc.), dimethylformamide, tetrahydrofuran, cellosolves (methyl cellosolve, etc.), lower ketones (acetone, MEK, etc.) and the like.

Suspension made of the pre-polymer (A) having isocyanate radical Formation may be formed by conducting reaction with the amines (B) in aqueous solvent, or the denatured polyester (i) may be used. As a method for stably forming suspension made of denatured polyester (i) or the pre-polymer (A) in the aqueous solution, there are the following methods. That is, there is a method where compound of toner material made of the denatured polyester (i) or the pre-polymer (A) is added in aqueous solvent, where suspension is made by shearing force. The pre-polymer (A) and toner materials which are other toner compounds such as coloring agent, coloring agent master batch, releasing agent, charge controlling agent, non-denatured polyester resin may be mixed when suspension is formed in an aqueous solvent. It is preferable that, after toner materials are mixed previously, the mixture is added in aqueous solvent. The coloring agent, the releasing agent, the charge controlling agent and the like are not mixed necessarily in advance when particles are formed in aqueous solvent. The agents may be added after particles are formed. For example, after particles which do not include coloring agent are formed, the coloring agent may be added in a known dying process.

Dispersion may be formed using a known suspension equipment such as a low-speed shearing type, a high-speed shearing type, a frictional type, a high-pressure jet type, or a ultrasonic type. Among them, it is preferable that the high-speed shearing type suspension machine is used in order to make particle size of suspension in a range of 2 to 20 micrometers. When the high-speed shearing suspension machine is used, its revolution per minute is not limited to a specific one, but it is preferably in a range of 1,000 to 3,000 revolutions per minute (rpm), and more preferably in a range of 5,000 to 20,000 rpm. The suspension time is also not limited to a specific one, but it will be in a range of 0.1 to 5 minutes or so. The temperature at the suspension time is in a range of 0 to 150° C. (under pressure), and preferably in a range of 40 to 98° C. As the temperature becomes higher temperature, suspension may be performed easily by lowering the viscosity of suspension made of the denatured polyester (i) or the pre-polymer (A).

The use amount of the aqueous solvent to toner compound (100 parts) containing the denatured polyester (i) or the pre-polymer (A) may be in a range of about 50 to 2,000 parts by weight. Preferably, it is in a range of 100 to 1,000 parts by weight. When the use amount is less than 50 parts by weight, suspension state of the toner compound is poor, so that toner particles with a predetermined particle size cannot be obtained. The use amount exceeding 2,000 parts by weight is not economical. Suspension agent may be used as needed. It is preferable that use of the suspension agent makes particle size distribution sharp and makes suspension stable.

The reason why the toner meeting the condition (b) is designated as the toner is as follows. That is, the particle size distribution (volume average particle diameter Dv/number average particle diameter Dn) is one of parameters representing the particle size distribution of toner. In dried toner where the volume average particle diameter Dv is in a range of 4.0 to 8.0 micrometers, and the volume average particle diameter Dv/number average particle diameter Dn is in a range of 1.05 to 1.30, and preferably in a range of 1.10 to 1.25, the particle size distribution of the toner becomes narrow, so that various merits can be obtained.

For example, since such a phenomenon that toner particles with particle diameters suitable for a pattern of an electrostatic latent image of the toner contribute to development preferentially to the other toner advances easily, there is a merit that images with various patterns can be formed stably. When such a constitution that toner remaining on an image carrier such as a photosensitive member is recovered and reused is adopted in an apparatus, toner particles with small sizes difficult to be transferred are much recycled quantitatively. When toner particles having a relatively large particle diameter distribution are uses in such a recycle use, particle size fluctuation becomes large in a period from supply of fresh toner to the next supply thereof, which results in adverse influence on the developing performance. In case of toner where the volume average particle diameter Dv is below the range, when the toner is used as two-component developer, the toner melts to adhere on a surface of the carrier due to a long term stirring in a developing unit, which results in lowering of charging capacity of the carrier. When such toner is used in one-component developer, filming of the toner on to the developing roller or melt-adhesion of the toner to a member such as a blade for thinning the toner is caused easily. On the contrary, when the volume average particle diameter Dv exceeds the above range, it becomes difficult to obtain an image with a high resolution and a high quality, and fluctuation of the particle diameter of toner becomes large when toner increases/decreases in the developer.

The particle diameter distribution of toner can be measured by using a measuring apparatus utilizing a Coulter counter method, for example, Coulter Counter TA-11 or Coulter Multisizer 11 (both by Beckman Coulter Inc.). Specifically, surface active agent (preferably, alkylbenzene sulphonate) of 0.1 to 1.5 milliliters is added in electrolytic aqueous solution of 100 to 150 milliliters as dispersing agent. Aqueous solution with about 1% NaCl prepared using first class sodium chloride, for example, ISO TON-II (Beckman Coulter Inc.) can be used as the electrolytic aqueous solution. A measurement sample is added to the obtained solution in an amount of 2 to 20 milligrams. The solution is subjected to a suspension processing for about 1 to 3 minutes, the volumes and the numbers of toner particles or toner are measured using apertures with a diameter of 100 micrometers as apertures by the above measuring apparatus, so that the volume distribution and the number distribution are calculated. The volume average particle diameter Dv and the number average particle diameter Dn of toner can be obtained from the obtained distributions. As channels, 13 channels of less than 2.00 to 2.52 micrometers, less than 2.52 to 3.17 micrometers, less than 3.17 to 4.00 micrometers, less than 4.00 to 5.04 micrometers, less than 5.04 to 6.35 micrometers, less than 6.35 to 8.00 micrometers, less than 8.00 to 10.08 micrometers, less than 10.08 to 12.70 micrometers, less than 12.70 to 16.00 micrometers, less than 16.00 to 20.20 micrometers, 20.20 to 25.40 micrometers, less than 25.40 to 32.00 micrometers, and 32.00 to 40.30 micrometers are used. Toner particles with particle diameters of 2.00 micrometers or more to less than 40.30 micrometers are subjected to be treated.

The reason why the toner meeting the condition (c) is designated as the toner is as follows. That is, in case of toner particles with an average circularity of less than 0.90, that is, toner particles having an amorphous shape rather than a spherical shape, deterioration of transfer property is caused urgently and transfer dust is easily caused urgently at a time of electrostatic transfer. When the average circularity is less than 0.90, it becomes difficult to form an image with high fineness which has a proper density and reproduceability. Further, when the average circularity exceeds 0.99, cleaning inferiority is caused on a member to be cleaned, such as the photosensitive member or the intermediate transfer belt in an apparatus adopting blade cleaning, so that dirt on an image is easily caused. When an image with a relatively low image area ratio is outputted, transfer residual toner is reduced so that the problem about the cleaning inferiority is also reduced. However, in case that an image with a high image area ratio, such as a color photograph image, is outputted, or in a case that an image with non-transferred state due to paper feeding inferiority or the like remains on the photosensitive member, cleaning inferiority becomes easy to occur. A more preferable range of the average circularity is 0.93 to 0.97. It is preferable that the amount of toner particles with the circularity of less than 0.94 should be suppressed to 10% or less.

The average circularity of toner can be measured as follows. That is, suspension solution including toner particles to be examined is caused to pass through an image pickup section detecting strip on a flat plate, and particle images in the suspension solution are photographed optically by a charge coupled device (CCD) camera. Regarding individual particle images, an average value of values obtained by dividing peripheral lengths of corresponding circles of equal projection areas by peripheral lengths of actual particles is calculated. In order to measure such an average circularity, for example, a flow type particle image analyzing apparatus FPIA-2100 (by Toa Medical Electronics) may be used. When this apparatus is used, surface active agent, preferably, alkylbenzenesulfonic acid salt of 0.1 to 1.5 milliliters is first added in electrolytic aqueous solution of 100 to 150 milliliters as dispersing agent, and is further added with toner to be examined in an amount of about 0.1 to 0.5 gram. The suspension solution thus obtained is subjected to a dispersing processing for about 1 to 3 minutes. The concentration of the dispersed solution is adjusted to 3,000 to 10,000 particles/μl, and the shapes and distribution of the toner particles are measured in the apparatus.

The reason why the magnetic carrier meeting the condition (d) is designated as the magnetic carrier is as follows. That is, excellent covering ratio can be achieved and toner scattering or background dirt can be suppressed effectively due to that the volume average particle diameter has a small diameter such as a value in the range of 25 to 55 micrometers. It becomes possible to reproduce a toner image to a latent image with high fidelity, or a toner image reproduced faithfully can be kept stable for a long term.

When a potential of a non-exposure portion which is a background portion potential of each photosensitive member (11Y, 11M, 11C, 11K), a potential of an exposure portion (a latent image potential), and a value of a developing bias are represented by $E_D$, $E_L$, and $E_B$, respectively, this printer is constituted so as to meet following equation $$0<|E_D|-|E_B|<|E_D-E_L|<400 \text{ volts.}$$

In this relational equation, the term "$|E_D|-|E_B|$" represents a potential difference between the background portion and the developing bias. The term "$|E_D-E_L|$" represents a potential difference between the background portion and the exposure portion. By make the latter potential difference larger than the former potential difference, adhesion of toner onto the background portion can be suppressed effectively. By suppressing the latter potential difference to less than 400 volts, discharging between the background portion and the exposure portion due to excessive potential difference can be avoided. This fact can be backed up by Paschen's discharge theory. Of course, the developing bias means a direct current (DC) bias.

Exemplary embodiments of the developing unit or printer to which the present invention is applied have been explained so far, but the present invention is also applicable to a process unit (10Y, 10M, 10C, 10K). The process unit is constituted by unitizing a latent image carrier such as a photosensitive member and a developing unit by one supporting member. The developing unit or the printer of the two-component developing system has been explained, but the present invention is also applicable to a developing unit, a printer or a process unit where one-component developer containing magnetic toner as a main component is used in one-component developing system.

In the printer according to the embodiment, the doctor magnet serving as the restricting magnet is chambered at its ridge corner defined by a face thereof facing the surface of the developing sleeve (22) serving as the developer carrier and a face thereof facing the upstream adjacent magnet. As described above, degradation of toner or magnetic carrier can be suppressed by making the size of the immovable layer sufficiently small without unstableness of the conveying amount of developer or the charging quantity of toner due to such a fact that the angle between the doctor blade (24) and the upstream adjacent magnetic pole P6 is expanded so that the size of the immovable layer is made small.

In the printer according to the embodiment, the value of the peak point Pa is suppressed to 50% of the peak value of the magnetic flux density I the normal direction generated by the doctor magnetic pole P7 serving as the restricting member. With such a constitution, as previously described, sufficient charging rising of toner can be realized without application of excessive stress on toner.

In the printer according to the embodiment, the magnetic member (30) made from magnetic material is fixed to the doctor blade (22) serving as the restricting member. With such a constitution, as described above, even if the size of the immovable layer in the sleeve rotational direction is made small, the two-component developer is stayed concentrically in the vicinity of the doctor blade (24) fluctuation of the two-component developer on the upstream side of the staying portion of the developer is absorbed at the staying portion to a certain extent. A stable amount of two-component developer is then fed into the doctor gap, so that unstableness of the conveying amount of developer to the developing region or the charging quantity of toner due to size reduction of the immovable layer can be suppressed.

In the printer according to the embodiment, an end portion of the magnetic member (30) on the opposite side of the developing sleeve (22) is covered with the developing case (21) made from non-magnetic material so as not to come in contact with the two-component developer on the developer sleeve. With such a constitution, as described above, the end portion of the magnetic member (30) easily magnetized on the opposite side is covered with the non-magnetic material where magnetic restraint of the two-component developer is avoided, so that the developing motor driving torque can be reduced.

In the printer according to the embodiment, as the magnet roller (23) serving as the magnetic force generator, one where magnetic force of each magnetic pole has a strength making the density ρ of two-component developer present on the upstream side of the doctor blade (24) in the sleeve rotational direction smaller than the compression density ρT of the two-component developer, is used. With such a constitution, as described above, noticeable lowering of the granularity on an output image due to the density ρ of the two-component developer conveyed to the developing region is excessively high can be avoided.

In the printer according to the embodiment, at least one conveying magnetic pole P (the first conveying magnetic pole P5) for constraining and conveying two-component developer on the surface of the developing sleeve (22) between the pumping magnetic pole P4 and the upstream adjacent magnetic pole P6 in the sleeve rotational direction is provided. With such a constitution, as previously stated, unstableness of the conveying amount of developer to the developing region or the charging quantity of toner due to size reduction of the immovable layer in the sleeve rotational direction can further be suppressed.

In the printer according to the embodiment, as the toner used in development of a latent image, one meeting the condition (a) is designated. With such a constitution, transfer dust or print can be suppressed to an inconspicuous level, as far as the designated toner is used.

In the printer according to the embodiment, as the toner used in development of a latent image, one meeting the condition (b) is designated. With such a constitution, an image with a high image quality which has been developed with stable developing performance can be obtained, as far as the designated toner is used.

In the printer according to the embodiment, as the toner used in development of a latent image, one meeting the condition (c) is designated. With such a constitution, an image with a high image quality, whose transfer dust has been suppressed with a stable electrostatic transfer rate while transfer shortage is being suppressed, as far as the designated toner is used.

In the printer according to the embodiment, as the magnetic carrier used in two-component developer, one meeting the condition (d) is designated. With such a constitution, toner scattering or background dirt can be suppressed effectively, as far as the designated magnetic carrier is used. Further, a toner image can be reproduced faithfully to a latent image, or a toner image reproduced faithfully can be kept stable for a long term.

In the printer according to the embodiment, the non-exposure portion potential $E_D$, the exposure portion potential $E_L$, and the developing bias $E_B$ are set so as to meet the relational equation shown in the above. With such a constitution, as described above, discharging between the background portion and the exposure portion due to an excessive potential difference therebetween can be avoided, while adhesion of toner to the background portion is being suppressed effectively.

In the present invention, the length of the immovable layer of developer, which is formed on an upstream side of the restricting member in a direction of surface movement of the developer carrier, in the direction thereof can be reduced.

Specifically, as a result of studies by the present inventors, they have found that, as the peak point of the magnetic flux density in the tangential direction on the surface of the magnetic force generator is caused to approach to the restricting magnet between the restricting magnetic pole of the magnetic force generator and the upstream adjacent magnetic pole adjacent thereto, the length of the immovable layer formed on the surface of the developer carrier becomes shorter.

The present inventors have found that the peak point can be caused to approach to the restricting magnetic pole by chamfering the ridge corner portion defined by the face of the restricting magnet with the restricting magnetic pole facing the surface of the developer carrier and the face thereof facing the upstream adjacent magnet with the upstream adjacent magnetic pole. The reason why the peak point approaches to the restricting magnetic pole is because lines of magnetic force extending toward the upstream adjacent magnet from the ridge corner portion in a parabolic manner unless the ridge corner portion is chamfered extend toward the restricting member due to chamfering. Even if a restricting magnet having a smaller length in the surface movement is used instead of the chamfering, the peak point can be caused to approach to the restricting member. In this case, however, the magnetic flux density at the peak point becomes insufficient so that the necessary amount of developer can be secured in the vicinity of the restricting member. With the chamfering, while magnetic force reduction of the whole magnet is suppressed to secure the magnetic flux density of the necessary level at the peak point, the peak point can be cause to further approach to the restricting member.

The present inventors have found that, for suppressing degradation progress of developer reliably, it is desirable to position the peak point on the upstream side, in the direction of surface movement of the developer carrier, of a point where the magnetic flux density on the surface of the developer carrier in the normal direction between the upstream adjacent magnetic pole and the restricting magnetic pole becomes zero.

In the present invention having the constitution of a first aspect where the chamfering has been performed on the restricting magnet or the constitution of a second aspect where the peak point is positioned on the downstream side of a vertical line extending from the boundary point of opposite magnetic fields in the direction of the surface movement, the length of the immovable layer in the direction of the surface movement can be reduced. New stress due to the magnet roller for the developer retaining described in the Japanese Patent Application Laid-open No. H9-146374 or the cylindrical developer conveying member described in the Japanese Patent Application Laid-open No. H5-35067 is prevented from being applied to developer. Accordingly, degradation progress of two-component developer or magnetic one-component developer can be suppressed more reliably as compared with the conventional art.

According to the above aspects, such an advantage can be achieved that degradation progress of two-component developer or magnetic one-component developer can be suppressed reliably.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A developing unit that develops a latent image carried on a latent image carrier of an image forming apparatus, comprising:

a developer containing unit that contains developer;

a developer carrier that has a moving surface, and carries the developer on the moving surface;

a magnetic force generator that attracts the developer onto the moving surface by a magnetic force generated from a plurality of magnets arranged along the moving surface; and a restricting member that restricts a layer thickness of the developer carried on the moving surface, wherein, the magnets include a restricting magnet that is arranged closest to the restricting member and has a restricting magnetic pole, a first surface of the restricting magnet toward the moving surface and a second surface of the restricting magnet toward an upstream adjacent magnet that is arranged so as to be adjacent to an upstream side of the developer carrier in a direction of movement of the moving surface and has an upstream adjacent magnetic pole forming a ridged corner portion, and the ridged corner portion is chamfered.

2. The developing unit according to claim 1, wherein at least a portion of the restricting member is formed by magnetic material or a magnetic member made of the magnetic material is fixed to the restricting member.

3. The developing unit according to claim 2, wherein the portion of the restricting member or an end portion of the restricting member positioned on an opposite side to the developer carrier is covered with non-magnetic material so as not to make a direct contact with developer on the developer carrier.

4. The developing unit according to claim 1, wherein magnetic force of each of magnetic poles of the magnetic force generator has a strength that makes a density $\rho$ of the developer on the upstream side of the restricting member in the direction of movement of the moving surface smaller than a compression density $\rho T$ of the developer compressed by imparting predetermined impact to the developer.

5. The developing unit according to claim 2, wherein at least one conveying magnetic pole that restricts and conveys the developer on the surface of the developer carrier is provided between a pumping magnetic pole for attracting and pumping the developer from the developer containing unit onto the developer carrier and the upstream adjacent magnetic pole in the direction of movement of the moving surface.

6. A developing unit that develops a latent image carried on a latent image carrier of an image forming apparatus, comprising:

a developer containing unit that contains developer;

a developer carrier that has a moving surface, and carries the developer on the moving surface;

a magnetic force generator that attracts the developer onto the moving surface by a magnetic force generated from a plurality of magnets arranged along the moving surface; and a restricting member that restricts a layer thickness of the developer carried on the moving surface, wherein, the magnetic force generator is constituted in such a manner that a peak point of magnetic flux density on the moving surface in a direction parallel to the moving surface between a restricting magnetic pole that is arranged closest to the restricting member and an upstream adjacent magnetic pole that is arranged so as to be adjacent to the restricting magnetic pole on an upstream side of the developer carrier in a direction of movement of the moving surface is positioned on a downstream side in the direction of movement of the moving surface than a point where the magnetic force density in a normal direction to the moving surface formed by opposite magnetic poles becomes zero, wherein the restricting magnetic pole is provided in a restricting magnet, the upstream adjacent magnetic pole is provided in an upstream adjacent magnet arranged so as to be adjacent to the restricting magnet on an upstream side in the direction of movement of the moving surface, and a first surface of the restricting magnet toward the moving surface and a second surface of the restricting magnet toward an adjacent magnet that is arranged so as to be adjacent to an upstream side of the developer carrier in a direction of movement of the moving surface and has an upstream adjacent magnetic pole forming a ridged corner portion, and the ridged corner portion is chamfered.

7. The developing unit according to claim 6, wherein the value of the peak point is set to be equal to or less than 50% of a peak value of the magnetic flux density on the moving surface in the normal direction formed by the restricting magnetic pole.

8. The developing unit according to claim 6, wherein at least a portion of the restricting member is formed by magnetic material or a magnetic member made of the magnetic material is fixed to the restricting member.

9. The developing unit according to claim 8, wherein the portion of the restricting member or an end portion of the restricting member positioned on an opposite side to the developer carrier is covered with non-magnetic material so as not to make a direct contact with developer on the developer carrier.

10. The developing unit according to claim 6, wherein magnetic force of each of magnetic poles of the magnetic force generator has a strength that makes a density ρ of the developer on the upstream side of the restricting member in the direction of movement of the moving surface smaller than a compression density ρT of the developer compressed by imparting predetermined impact to the developer.

11. The developing unit according to claim 8, wherein at least one conveying magnetic pole that restricts and conveys the developer on the surface of the developer carrier is provided between a pumping magnetic pole for attracting and pumping the developer from the developer containing unit onto the developer carrier and the upstream adjacent magnetic pole in the direction of movement of the moving surface.

12. An image forming apparatus comprising:

a latent image carrier that carries a latent image; and a developing unit that develops the latent image carried on the latent image carrier, wherein the developing unit includes a developer containing unit that contains developer;

a developer carrier that has a moving surface, and carries the developer on the moving surface;

a magnetic force generator that attracts the developer onto the moving surface by a magnetic force generated from a plurality of magnets arranged along the moving surface; and a restricting member that restricts a layer thickness of the developer carried on the moving surface, wherein, the magnets includes a restricting magnet that is arranged closest to the restricting member and has a restricting magnetic pole, a first surface of the restricting magnet toward the moving surface and a second surface of the restricting magnet toward an upstream adjacent magnet that is arranged so as to be adjacent to an upstream side of the developer carrier in a direction of movement of the moving surface and has an upstream adjacent magnetic pole forming a ridged corner portion, and the ridged corner portion is chamfered.

13. The image forming apparatus according to claim 12, further comprising a toner containing unit that contains toner for developing the latent image, wherein the toner is produced by a polymerization process using denatured polyester resin as base material.

14. The image forming apparatus according to claim 12, wherein the toner is designated to be produced by the polymerization process using denatured polyester resin as base material.

15. The image forming apparatus according to claim 12, wherein the toner is designated to have a weight average particle diameter in a range between 4.0 micrometers and 8.0 micrometers and a particle diameter distribution equal to or less than 1.25.

16. The image forming apparatus according to claim 12, wherein the toner is designated to have an average circularity equal to or more than 0.90 and less than 1.0.

17. The image forming apparatus according to claim 12, wherein the developer is two-component developer containing toner and magnetic particle, and the magnetic particle is designated to have a volume average particle diameter in a range between 25 micrometers and 55 micrometers.

18. The image forming apparatus according to claim 12, wherein direct current developing bias is applied to the developer carrier, the latent image is carried on the latent image carrier by decreasing a potential at an exposure portion of a photosensitive layer formed on a surface of a photosensitive member, and following relation is satisfied $$0<|E_D|-|E_B|<|E_D-E_L|<400 \text{ volts}$$

wherein $E_D$ is a potential of a non-exposure portion of the photosensitive layer, $E_L$ is the potential of the exposure portion, and $E_B$ is a value of the developing bias.

19. A developing unit that develops a latent image carried on a latent image carrier of an image forming apparatus, comprising:

a developer containing unit that contains developer;

a developer carrier that has a moving surface, and carries the developer on the moving surface;

a magnetic force generator that attracts the developer onto the moving surface by a magnetic force generated from a plurality of magnets arranged along the moving surface; and a restricting member that restricts a layer thickness of the developer carried on the moving surface, wherein, the magnetic force generator is constituted in such a manner that a peak point of magnetic flux density on the moving surface in a direction parallel to the moving surface between a restricting magnetic pole that is positioned so as to face the restricting member and an upstream adjacent magnetic pole that is arranged so as to be adjacent to the restricting magnetic pole on an upstream side of the developer carrier in a direction of movement of the moving surface is positioned on a downstream side in the direction of movement of the moving surface than a point where the magnetic force density in a normal direction to the moving surface formed by opposite magnetic poles becomes zero.

20. The developing unit according to claim 19, wherein the restricting magnetic pole is provided in a restricting magnet, the upstream adjacent magnetic pole is provided in an upstream adjacent magnet arranged so as to be adjacent to the restricting magnet on an upstream side in the direction of movement of the moving surface, and a first surface of the restricting magnet toward the moving surface and a second surface of the restricting magnet toward an adjacent magnet that is arranged so as to be adjacent to an upstream side of the developer carrier in a direction of movement of the moving surface and has an upstream adjacent magnetic pole forming a ridged corner portion, and the ridged corner portion is chamfered.

21. The developing unit according to claim 19, wherein the value of the peak point is set to be equal to or less than 50% of a peak value of the magnetic flux density on the moving surface in the normal direction formed by the restricting magnetic pole.

22. The developing unit according to claim 19, wherein at least a portion of the restricting member is formed by magnetic material or a magnetic member made of the magnetic material is fixed to the restricting member.

23. The developing unit according to claim 19, wherein the portion of the restricting member or an end portion of the restricting member positioned on an opposite side to the developer carrier is covered with non-magnetic material so as not to make a direct contact with developer on the developer carrier.

24. The developing unit according to claim 19, wherein magnetic force of each of magnetic poles of the magnetic force generator has a strength that makes a density $\rho$ of the developer on the upstream side of the restricting member in the direction of movement of the moving surface smaller than a compression density $\rho T$ of the developer compressed by imparting predetermined impact to the developer.

25. The developing unit according to claim 19, wherein at least one conveying magnetic pole that restricts and conveys the developer on the surface of the developer carrier is provided between a pumping magnetic pole for attracting and pumping the developer from the developer containing unit onto the developer carrier and the upstream adjacent magnetic pole in the direction of movement of the moving surface.

26. A developing unit that develops a latent image carried on a latent image carrier of an image forming apparatus, comprising:

a developer containing unit that contains developer;

a developer carrier that has a moving surface, and carries the developer on the moving surface;

a magnetic force generator that attracts the developer onto the moving surface by a magnetic force generated from a plurality of magnets arranged along the moving surface; and a restricting member that restricts a layer thickness of the developer carried on the moving surface, wherein, the magnetic force generator is constituted in such a manner that a peak point of magnetic flux density on the moving surface in a direction parallel to the moving surface between a restricting magnetic pole that is arranged closest to the restricting member and an upstream adjacent magnetic pole that is arranged so as to be adjacent to the restricting magnetic pole on an upstream side of the developer carrier in a direction of movement of the moving surface is positioned on a downstream side in the direction of movement of the moving surface than a point where the magnetic force density in a normal direction to the moving surface formed by opposite magnetic poles becomes zero, wherein at least a portion of the restricting member is formed by magnetic material or a magnetic member made of the magnetic material is fixed to the restricting member, and at least one conveying magnetic pole that restricts and conveys the developer on the surface of the developer carrier is provided between a pumping magnetic pole for attracting and pumping the developer from the developer containing unit onto the developer carrier and the upstream adjacent magnetic pole in the direction of movement of the moving surface.

27. The developing unit according to claim 26, wherein the restricting magnetic pole is provided in a restricting magnet, the upstream adjacent magnetic pole is provided in an upstream adjacent magnet arranged so as to be adjacent to the restricting magnet on an upstream side in the direction of movement of the moving surface, and a first surface of the restricting magnet toward the moving surface and a second surface of the restricting magnet toward an adjacent magnet that is arranged so as to be adjacent to an upstream side of the developer carrier in a direction of movement of the moving surface and has an upstream adjacent magnetic pole forming a ridged corner portion, and the ridged corner portion is chamfered.

28. The developing unit according to claim 26, wherein the value of the peak point is set to be equal to or less than 50% of a peak value of the magnetic flux density on the moving surface in the normal direction formed by the restricting magnetic pole.

29. The developing unit according to claim 26, wherein the portion of the restricting member or an end portion of the restricting member positioned on an opposite side to the developer carrier is covered with non-magnetic material so as not to make a direct contact with developer on the developer carrier.

30. The developing unit according to claim 26, wherein magnetic force of each of magnetic poles of the magnetic force generator has a strength that makes a density $\rho$ of the developer on the upstream side of the restricting member in the direction of movement of the moving surface smaller than a compression density $\rho T$ of the developer compressed by imparting predetermined impact to the developer.

31. An image forming apparatus comprising:

a latent image carrier that carries a latent image; and a developing unit that develops the latent image carried on the latent image carrier, wherein the developing unit includes a developer containing unit that contains developer;

a developer carrier that has a moving surface, and carries the developer on the moving surface;

a magnetic force generator that attracts the developer onto the moving surface by a magnetic force generated from a plurality of magnets arranged along the moving surface; and a restricting member that restricts a layer thickness of the developer carried on the moving surface, wherein, the magnetic force generator is constituted in such a manner that a peak point of magnetic flux density on the moving surface in a direction parallel to the moving surface between a restricting magnetic pole that is positioned so as to face the restricting member and an upstream adjacent magnetic pole that is arranged so as to be adjacent to the restricting magnetic pole on an upstream side of the developer carrier in a direction of movement of the moving surface is positioned on a downstream side in the direction of movement of the moving surface than a point where the magnetic force density in a normal direction to the moving surface formed by opposite magnetic poles becomes zero.

32. The image forming apparatus according to claim 31, further comprising a toner containing unit that contains toner for developing the latent image, wherein the toner is produced by a polymerization process using denatured polyester resin as base material.

33. The image forming apparatus according to claim 31, wherein the toner is designated to be produced by the polymerization process using denatured polyester resin as base material.

34. The image forming apparatus according to claim 31, wherein the toner is designated to have a weight average particle diameter in a range between 4.0 micrometers and 8.0 micrometers and a particle diameter distribution equal to or less than 1.25.

35. The image forming apparatus according to claim 31, wherein the toner is designated to have an average circularity equal to or more than 0.90 and less than 1.0.

36. The image forming apparatus according to claim 31, wherein the developer is two-component developer containing toner and magnetic particle, and the magnetic particle is designated to have a volume average particle diameter in a range between 25 micrometers and 55 micrometers.

37. The image forming apparatus according to claim 31, wherein direct current developing bias is applied to the developer carrier, the latent image is carried on the latent image carrier by decreasing a potential at an exposure portion of a photosensitive layer formed on a surface of a photosensitive member, and following relation is satisfied $$0<|E_D|-|E_B|<|E_D-E_L|<400 \text{ volts}$$

wherein $E_D$ is a potential of a non-exposure portion of the photosensitive layer, $E_L$ is the potential of the exposure portion, and $E_B$ is a value of the developing bias.

38. An image forming apparatus comprising:

a latent image carrier that carries a latent image; and a developing unit that develops the latent image carried on the latent image carrier, wherein the developing unit includes a developer containing unit that contains developer;

a developer carrier that has a moving surface, and carries the developer on the moving surface;

a magnetic force generator that attracts the developer onto the moving surface by a magnetic force generated from a plurality of magnets arranged along the moving surface; and a restricting member that restricts a layer thickness of the developer carried on the moving surface, wherein, the magnetic force generator is constituted in such a manner that a peak point of magnetic flux density on the moving surface in a direction parallel to the moving surface between a restricting magnetic pole that is arranged closest to the restricting member and an upstream adjacent magnetic pole that is arranged so as to be adjacent to the restricting magnetic pole on an upstream side of the developer carrier in a direction of movement of the moving surface is positioned on a downstream side in the direction of movement of the moving surface than a point where the magnetic force density in a normal direction to the moving surface formed by opposite magnetic poles becomes zero, wherein the restricting magnetic pole is provided in a restricting magnet, the upstream adjacent magnetic pole is provided in an upstream adjacent magnet arranged so as to be adjacent to the restricting magnet on an upstream side in the direction of movement of the moving surface, and a first surface of the restricting magnet toward the moving surface and a second surface of the restricting magnet toward an adjacent magnet that is arranged so as to be adjacent to an upstream side of the developer carrier in a direction of movement of the moving surface and has an upstream adjacent magnetic pole forming a ridged corner portion, and the ridged corner portion is chamfered.

39. The image forming apparatus according to claim 38, further comprising a toner containing unit that contains toner for developing the latent image, wherein the toner is produced by a polymerization process using denatured polyester resin as base material.

40. The image forming apparatus according to claim 38, wherein the toner is designated to be produced by the polymerization process using denatured polyester resin as base material.

41. The image forming apparatus according to claim 38, wherein the toner is designated to have a weight average particle diameter in a range between 4.0 micrometers and 8.0 micrometers and a particle diameter distribution equal to or less than 1.25.

42. The image forming apparatus according to claim 38, wherein the toner is designated to have an average circularity equal to or more than 0.90 and less than 1.0.

43. The image forming apparatus according to claim 38, wherein the developer is two-component developer containing toner and magnetic particle, and the magnetic particle is designated to have a volume average particle diameter in a range between 25 micrometers and 55 micrometers.

44. The image forming apparatus according to claim 38, wherein direct current developing bias is applied to the developer carrier, the latent image is carried on the latent image carrier by decreasing a potential at an exposure portion of a photosensitive layer formed on a surface of a photosensitive member, and following relation is satisfied $$0<|E_D|-|E_B|<|E_D-E_L|<400 \text{ volts}$$

wherein $E_D$ is a potential of a non-exposure portion of the photosensitive layer, $E_L$ is the potential of the exposure portion, and $E_B$ is a value of the developing bias.

* * * * *